US011760602B2

(12) United States Patent
Ichinose et al.

(10) Patent No.: US 11,760,602 B2
(45) Date of Patent: Sep. 19, 2023

(54) LEAD WIRE PULLING OUT MECHANISM

(71) Applicant: Toshiba Mitsubishi-Electric Industrial Systems Corporation, Chuo-ku (JP)

(72) Inventors: Akihiro Ichinose, Tokyo (JP); Yoshihito Yamada, Tokyo (JP)

(73) Assignee: Toshiba Mitsubishi-Electric Industrial Systems Corporation, Chuo-ku (JP)

( * ) Notice: Subject to any disclaimer, the term of this patent is extended or adjusted under 35 U.S.C. 154(b) by 209 days.

(21) Appl. No.: 16/960,231

(22) PCT Filed: Jul. 31, 2019

(86) PCT No.: PCT/JP2019/029940
§ 371 (c)(1),
(2) Date: Jul. 6, 2020

(87) PCT Pub. No.: WO2021/019705
PCT Pub. Date: Feb. 4, 2021

(65) Prior Publication Data
US 2022/0002112 A1 Jan. 6, 2022

(51) Int. Cl.
*B65H 57/00* (2006.01)
*B65H 51/18* (2006.01)
(Continued)

(52) U.S. Cl.
CPC ..... *B65H 57/003* (2013.01); *B21C 47/34* (2013.01); *B65H 49/26* (2013.01); *B65H 51/18* (2013.01);
(Continued)

(58) Field of Classification Search
CPC ..... B65H 57/003; B65H 51/18; B65H 59/32; B65H 63/024; B65H 75/285
See application file for complete search history.

(56) References Cited

U.S. PATENT DOCUMENTS 6,027,062 A * 2/2000 Bacon ..... B65H 57/003 242/157.1

FOREIGN PATENT DOCUMENTS

CN 104034582 A 9/2014
JP 56-17868 A 2/1981
(Continued)

OTHER PUBLICATIONS

International Search Report dated Sep. 17, 2019 in PCT/JP2019/029940 filed on Jul. 31, 2019, 2 pages.
International Preliminary Report and Written Opinion dated Feb. 1, 2022 in PCT/JP201 9/029940 (with English translation), 13 pages.
Japanese Office Action dated Oct. 20, 2020 in Japanese Patent Application No. 2019-572254 (with English translation), 6 pages.
(Continued)

*Primary Examiner* — William E Dondero
(74) *Attorney, Agent, or Firm* — Oblon, McClelland, Maier & Neustadt, L.L.P.

(57) ABSTRACT

A lead wire storage mechanism stores most of a lead wire such that the lead wire can be taken out from a tip end portion. A tension adjusting mechanism including a dancer roller and two lifting and lowering guide rollers is formed with a partial space that is to be a part of a hand travel space at a time of a preparation state. A lead wire guide mechanism including an opening and closing lead guide is formed with a partial space that is to be a part of the hand travel space at the time of the preparation state. A lead wire grasping and moving mechanism can execute a grasping operation for grasping a tip end portion of the lead wire with a grasping part, and a grasping part moving operation for moving the grasping part through the hand travel space.

4 Claims, 22 Drawing Sheets

(51) Int. Cl.

| | |
|---|---|
| ***B65H 63/024*** | (2006.01) |
| ***B65H 59/32*** | (2006.01) |
| ***B65H 75/28*** | (2006.01) |
| ***B65H 49/26*** | (2006.01) |
| ***B65H 57/02*** | (2006.01) |
| ***B65H 59/38*** | (2006.01) |
| ***B21C 47/34*** | (2006.01) |

(52) U.S. Cl.

CPC ..... *B65H 57/02* (2013.01); *B65H 59/32* (2013.01); *B65H 59/384* (2013.01); *B65H 63/024* (2013.01); *B65H 75/285* (2013.01); *B65H 2220/03* (2013.01); *B65H 2511/52* (2013.01); *B65H 2701/36* (2013.01)

(56) References Cited

FOREIGN PATENT DOCUMENTS

| | | | |
|---|---|---|---|
| JP | 2-99219 | A | 4/1990 |
| JP | 7-1 37939 | A | 5/1995 |
| JP | 2015-133861 | A | 7/2015 |
| WO | WO 2012/073318 | A1 | 6/2012 |

OTHER PUBLICATIONS

Combined Chinese Office Action and Search Report dated Feb. 28, 2022 in corresponding Chinese Patent Application No. 201980052547.7 (with English Translation), 18 pages.

Office Action dated Jul. 11, 2022, in Korean Patent Application No. 10-2021-7003810 w/English-language Translation.

* cited by examiner

LEAD WIRE PULLING OUT MECHANISM

TECHNICAL FIELD

The present invention relates to a lead wire pulling out mechanism that draws and guides a lead wire to a target position.

BACKGROUND ART

As an equipment to weld a lead wire serving as an electrode wire, to an electrode film surface of a substrate to be used for manufacturing a solar cell or the like, there is an ultrasonic welding equipment utilizing ultrasonic vibration. When such an ultrasonic welding equipment is used, there is required a technique for pulling out a lead wire, which is a line-shaped conductive material, onto a substrate.

As a lead wire pulling out technique, for example, there are a lead wire pulling out structure disclosed in Patent Document 1 and a lead wire pulling out mechanism disclosed in Patent Document 2.

A conventional lead wire pulling out technique is a technique for pulling out a lead wire from a lead reel on which a lead wire is wound in multiple layers, and continuously guiding the lead wire to a target position. By pulling out the lead wire onto a substrate by the lead wire pulling out technique, and applying ultrasonic vibration by the ultrasonic welding equipment to the lead wire in a state of being in contact with the substrate, the lead wire can be welded onto the substrate.

PRIOR ART DOCUMENTS

Patent Documents

Patent Document 1: International Publication No. 2012/073318

Patent Document 2: Japanese Patent Application Laid-Open No. 2015-133861

SUMMARY

Problem to be Solved by the Invention

However, the conventional lead wire pulling out technique has a problem of requiring time and effort, because a lead wire pulling out initial setting process for first pulling out the lead wire and guiding to the target position has been performed by a manual operation by an operator.

An object of the present invention is to provide a lead wire pulling out mechanism that can solve the problem described above, and perform a lead wire pulling out initial setting process while eliminating necessity of a manual operation by hand.

Means to Solve the Problem

A lead wire pulling out mechanism according to the present invention includes: a lead wire storage mechanism that stores a lead wire to be capable of being taken out from a tip end portion; a lead wire grasping and moving mechanism that has a grasping part and is capable of executing a grasping operation for grasping a tip end portion of the lead wire with the grasping part, and a grasping part moving operation for moving the grasping part from an initial position to a target position through a lead wire movement space; a tension adjusting mechanism that has at least one roller, and executes a tension adjustment process for adjusting a tension applied to the lead wire, by maintaining a contact relationship between the at least one roller and the lead wire; a lead wire guide mechanism that executes a guide process for guiding a traveling direction of the lead wire by sandwiching the lead wire; and a control unit that controls the lead wire storage mechanism, the lead wire grasping and moving mechanism, the tension adjusting mechanism, and the lead wire guide mechanism, to control execution of a lead wire pulling out initial setting process, in which a state in the tension adjusting mechanism changes between a first preparation state of forming a first partial space that is to be a part of the lead wire movement space and a first actual operation state in which the tension adjustment process is executable, a state in the lead wire guide mechanism changes between a second preparation state of forming a second partial space that is to be a part of the lead wire movement space and a second actual operation state in which the guide process is executable, the lead wire pulling out initial setting process executed under control of the control unit includes the steps of: (a) causing the lead wire grasping and moving mechanism to execute the grasping operation at the initial position to grasp a tip end portion of the lead wire stored in the lead wire storage mechanism; (b) setting the tension adjusting mechanism to the first preparation state, and setting the lead wire guide mechanism to the second preparation state; and (c) causing the lead wire grasping and moving mechanism that is executing the grasping operation to further execute the grasping part moving operation to move the grasping part from the initial position to the target position, in which by execution of the step (c), a tip end portion of the lead wire grasped by the grasping part passes through the lead wire movement space including the first and second partial spaces, and then guided to the target position together with the grasping part, and the grasping part moving operation is ended after the execution of the step (c), and the lead wire pulling out initial setting process further includes the steps of: (d) after execution of the step (c), setting the tension adjusting mechanism to the first actual operation state and setting the lead wire guide mechanism to the second actual operation state; and (e) after execution of the step (c), ending the grasping operation by the grasping part and releasing the lead wire from the lead wire grasping and moving mechanism.

Effects of the Invention

The lead wire pulling out mechanism of an embodiment exhibits an effect of being able to guide the lead wire from the initial position to the target position while eliminating necessity of a manual operation by an operator, by automatically executing the lead wire pulling out initial setting process including steps (a) to (e) described above under control of the control unit.

Objects, features, aspects, and advantages of the present invention will become more apparent from the following detailed description and the accompanying drawings.

DESCRIPTION OF EMBODIMENT

<Underlying Technology>

Figure 22:
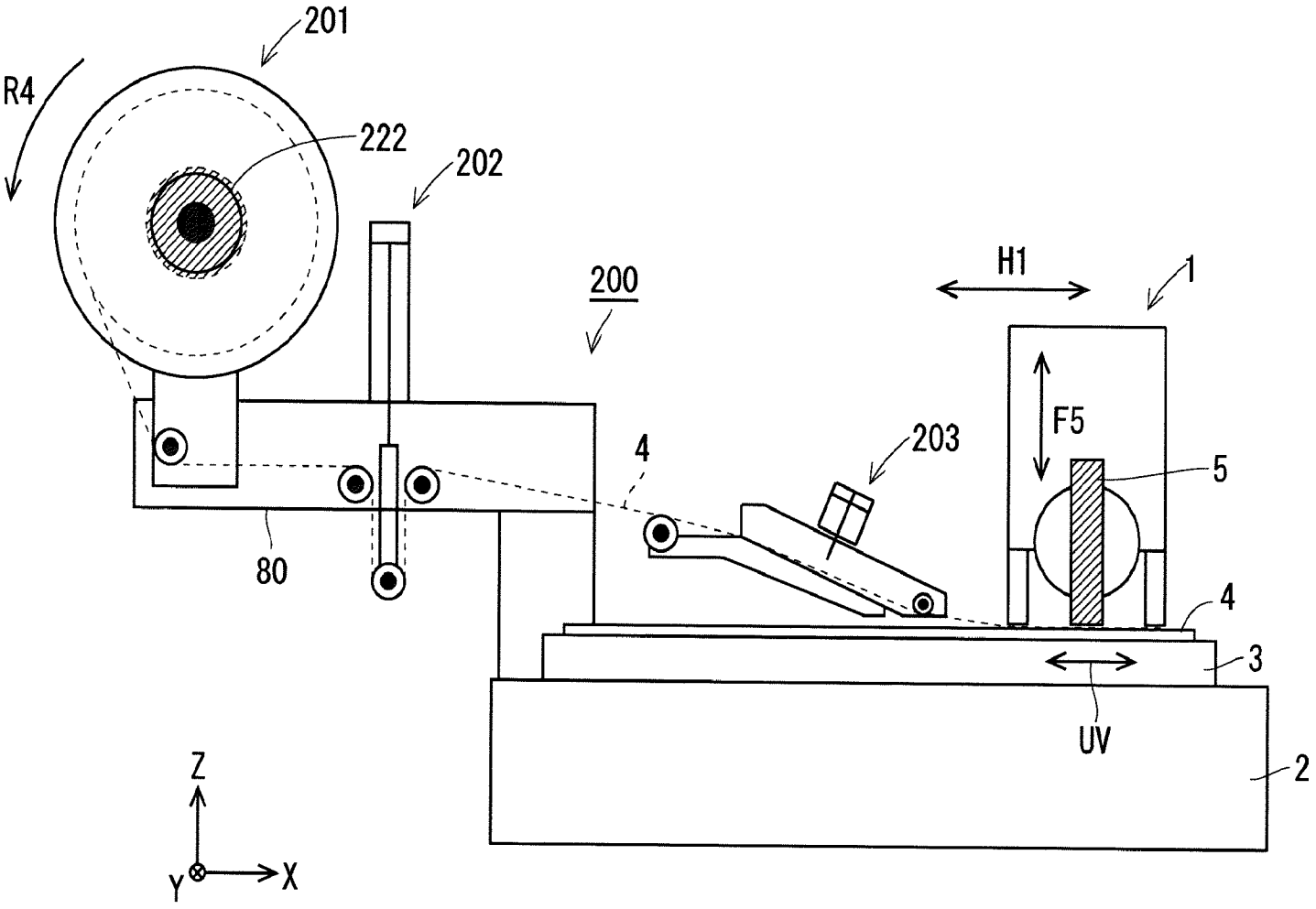
FIG. 22 is an explanatory view schematically showing a configuration of a lead wire pulling out mechanism as an underlying technology of the present invention.

FIG. 22 is an explanatory view schematically showing a configuration of a lead wire pulling out mechanism 200 as an underlying technology of the present invention. In the figure, an XYZ orthogonal coordinate system is shown.

As shown in FIG. 22, the lead wire pulling out mechanism 200 includes a lead wire storage mechanism 201, a tension adjusting mechanism 202, and a lead wire guide mechanism 203 as main components.

A substrate 3 is placed on a substrate fixing table 2, a lead wire 4 is disposed on the substrate 3, and the lead wire 4 can be ultrasonically welded onto the substrate 3 by executing an ultrasonic welding operation in which ultrasonic vibration UV is applied to a welding target region of the lead wire 4, from an ultrasonic oscillation head 5 of an ultrasonic welding equipment 1. Note that head pressurization F5 is applied to the ultrasonic oscillation head 5.

The lead wire storage mechanism 201 and the tension adjusting mechanism 202 are fixedly disposed on a mounting member 80 mounted to the substrate fixing table 2. The lead wire storage mechanism 201 has a support shaft 222 that can rotate along a rotation direction R4, the lead wire 4 is wound around the support shaft 222 as a central axis, a tip end portion of the lead wire 4 is exposed to the outside, and the lead wire 4 can be pulled out from outside.

While maintaining a contact relationship with various rollers of the tension adjusting mechanism 202, the lead wire 4 pulled out from the lead wire storage mechanism 201 is guided to a surface of the substrate 3 on a lower side (−Z direction) by being sandwiched and gently grasped by the lead wire guide mechanism 203 from above and below. In FIG. 22, a symbol "4" indicated by a rectangular solid line indicates a lead wire that has been welded onto the substrate 3, while a symbol "4" indicated by a broken line indicates the lead wire 4 in a process of being pulled out toward the surface of the substrate 3.

By the lead wire pulling out mechanism 200 with such a configuration as an underlying technology, the lead wire 4 stored in the lead wire storage mechanism 201 is pulled out to the surface of the substrate 3 such as a glass substrate placed on the substrate fixing table 2, via the tension adjusting mechanism 202 and the lead wire guide mechanism 203.

Thereafter, the lead wire 4 can be welded onto the substrate 3 by the ultrasonic welding equipment 1. Note that, when a solar cell is manufactured on the substrate 3, an electrode film is generally formed on the surface of the substrate 3, and in this case, the surface of the substrate 3 is to be a surface of the electrode film.

Furthermore, the ultrasonic welding equipment 1 is capable of horizontal movement in a horizontal movement direction H1 parallel to a surface formation direction (X direction) of the substrate 3, and the lead wire guide mechanism 203 is integrally connected to the ultrasonic welding equipment 1 and moves horizontally together with the ultrasonic welding equipment 1.

Therefore, for example, by moving the ultrasonic welding equipment 1 (ultrasonic oscillation head 5) and the lead wire guide mechanism 203 along a left direction (−X direction), it is possible to repeatedly execute the ultrasonic welding operation by the ultrasonic welding equipment 1 while changing the welding target region of the lead wire 4.

In the lead wire pulling out mechanism 200 as an underlying technology, the lead wire pulling out initial setting process has been performed in which the lead wire is first pulled out from the lead wire storage mechanism 201 and guided to the surface of the substrate 3, which is the target position, while passing through the tension adjusting mechanism 202 and the lead wire guide mechanism 203, by a manual operation by an operator.

That is, by a manual operation by the operator, a tip end portion of the lead wire 4 has been grasped and passed through the tension adjusting mechanism 202 from the lead wire storage mechanism 201 while being in contact with various rollers of the tension adjusting mechanism 202, then, the lead wire 4 has been passed through in such a manner that the lead wire 4 is sandwiched from above and below by the lead wire guide mechanism 203, and the tip end portion of the lead wire 4 has been guided to the surface of the substrate 3. As described above, the lead wire pulling out initial setting process described above has been performed by a manual operation by hand.

In a lead wire pulling out mechanism according to an embodiment described below, the lead wire pulling out initial setting process described above is adapted to be automatically performed.

EMBODIMENT (Configuration)

Figures 1A, 1B:
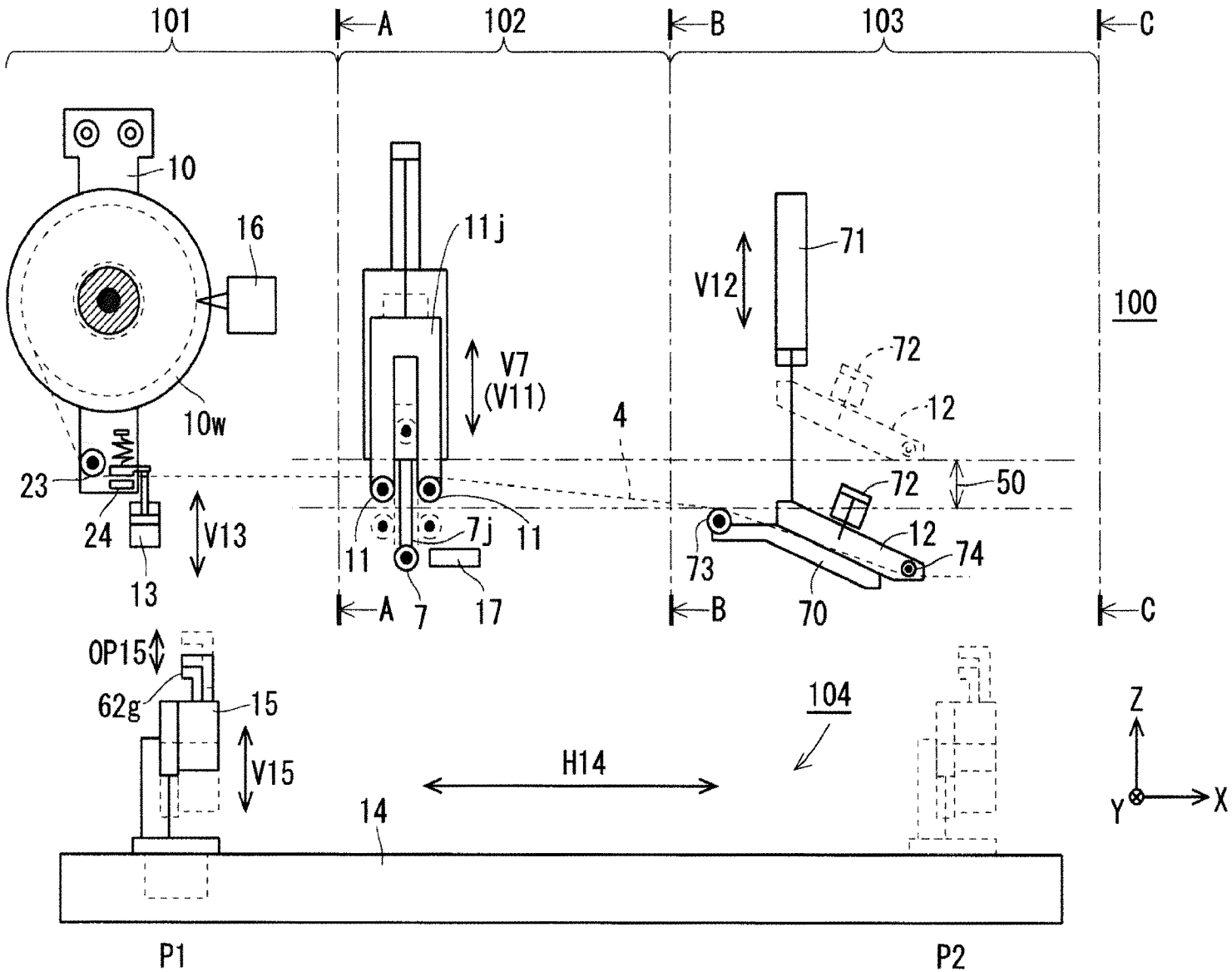
FIGS. 1A and 1B are explanatory views showing an overall configuration of a lead wire pulling out mechanism, which is an embodiment of the present invention.

FIGS. 1A and 1B are explanatory views schematically showing an overall configuration of a lead wire pulling out mechanism 100, which is an embodiment of the present invention. In FIGS. 1A and 1B, an XYZ orthogonal coordinate system is shown.

As shown in the figure, the lead wire pulling out mechanism 100 includes a lead wire storage mechanism 101, a tension adjusting mechanism 102, a lead wire guide mechanism 103, a lead wire grasping and moving mechanism 104, and a control unit 105 (not shown) as main components.

With the lead wire storage mechanism 101 as a reference, the tension adjusting mechanism 102 is provided in a preceding stage (−X side) of the lead wire guide mechanism 103.

Figure 2:
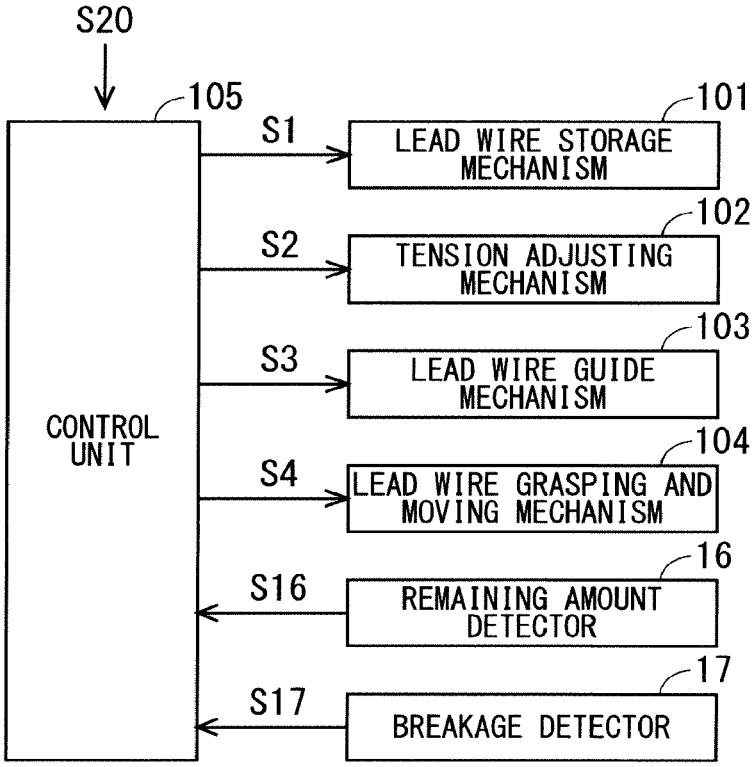
FIG. 2 is a block diagram schematically showing a control system of the lead wire pulling out mechanism shown in FIGS. 1A and 1B.

FIG. 2 is a block diagram schematically showing a control system of the lead wire pulling out mechanism 100. As shown in the figure, the control unit 105 outputs control signals S1 to S4. The control signal S1 is outputted to the lead wire storage mechanism 101, the control signal S2 is outputted to the tension adjusting mechanism 102, the control signal S3 is outputted to the lead wire guide mechanism 103, and the control signal S4 is outputted to the lead wire grasping and moving mechanism 104.

Whereas, a remaining amount detection signal S16 is outputted from a remaining amount detector 16 to be described later, and a breakage detection signal S17 is outputted from a breakage detector 17 to be described later. The remaining amount detection signal S16 and the breakage detection signal S17 are inputted to the control unit 105.

Furthermore, the control unit 105 receives an execution request signal S20 instructing execution of the lead wire pulling out initial setting process. The execution request signal S20 can be generated by an operator performing a predetermined operation. As the predetermined operation, for example, pressing of an execution start button (not shown) provided in the lead wire pulling out mechanism 100 and the like can be considered.

When the remaining amount detection signal S16 indicates a lead wire remaining amount shortage state to be described later, when the breakage detection signal S17 indicates breakage of the lead wire 4, or when the execution request signal S20 is received, the control unit 105 can recognize necessity of executing the lead wire pulling out initial setting process, which will be described in detail later.

By outputting the control signals S1 to S4 to the main components 101 to 104, the control unit 105 controls the lead wire storage mechanism 101, the tension adjusting mechanism 102, the lead wire guide mechanism 103, and the lead wire grasping and moving mechanism 104, to control execution of the lead wire pulling out initial setting process, which will be described in detail later.

Returning to FIGS. 1A and 1B, the lead wire storage mechanism 101 includes a lead cassette 10, an unlocking mechanism 13, and the remaining amount detector 16 as main components.

Figure 3:
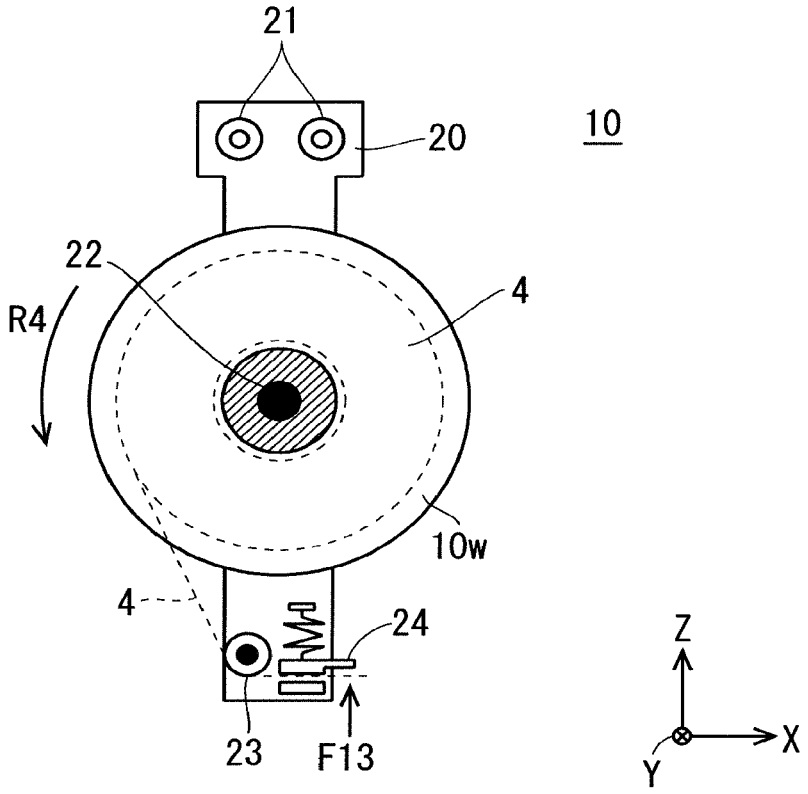
FIG. 3 is an explanatory view showing a configuration of a lead cassette in a lead wire storage mechanism shown in FIGS. 1A and 1B.

FIG. 3 is an explanatory view showing a configuration of the lead cassette 10 in the lead wire storage mechanism 101 shown in FIGS. 1A and 1B. In FIG. 3, an XYZ orthogonal coordinate system is shown. Note that, also in each of FIGS. 4 to 21 shown in the following, the XYZ orthogonal coordinate system is shown.

As shown in FIG. 3, in the lead cassette 10, most of the lead wire 4 is stored in a winding region 10*w* so as to be capable of being taken out from a tip end portion.

The lead cassette 10 includes a bracket 20, two guide holes 21, the support shaft 22, a guide roller 23, and a lock mechanism 24 as main components.

On the bracket 20, the two guide holes 21 are provided to an upper part (+Z direction side), the tension-variable support shaft 22 is mounted to a center part, and the guide roller 23 and the lock mechanism 24 are mounted to a lower part (−Z direction side). The guide roller 23 is provided for guiding the lead wire 4 toward the lock mechanism 24. Note that the tension-variable support shaft 22 and the guide roller 23 are mounted to the bracket 20 so as to be rotatable along the rotation direction R4 (counterclockwise).

The lead wire 4 is wound around the support shaft 22 as a central axis, and a tip end portion is positioned in the lock mechanism 24 while being in contact with a part of an outer peripheral surface of the guide roller 23. Most of the lead wire 4 is stored in the winding region 10*w*.

The support shaft 22 has a tension-variable function for generating a friction force that is appropriately adjusted such that the lead wire 4 does not loosen by rotating in an opposite direction with respect to a winding direction (=rotation direction R4).

Figure 4:
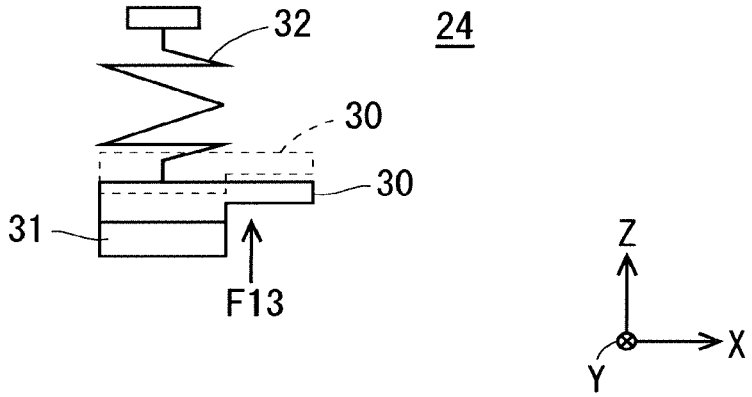
FIG. 4 is an explanatory view showing details of a lock mechanism shown in FIG. 3.

FIG. 4 is an explanatory view showing details of the lock mechanism 24 shown in FIG. 3. The unlocking mechanism 13 shown in FIGS. 1A and 1B can apply an unlocking force F13 to the lock mechanism 24 as necessary. Note that, for example, a cylinder can be considered as the unlocking mechanism 13.

As shown in FIG. 4, the lock mechanism 24 includes an upper lock fitting 30, a lower lock fitting 31, and a spring 32 as main components. In a state in which the unlocking force F13 is not applied from the unlocking mechanism 13, the lock fitting 30 is pushed down to a position indicated by a solid line since an elastic force of the spring 32 directed downward (−Z direction) is applied, which brings about a close contact state in which a lower surface of the lock fitting 30 is in close contact with an upper surface of the lock fitting 31.

Whereas, when the unlocking force F13 directed upward (+Z direction) is applied, the lock fitting 30 is pushed up to a position indicated by a broken line since the unlocking force F13 is applied to a part of the lower surface of the lock fitting 30, which brings about a space forming state in which a space is provided between the lower surface of the lock fitting 30 and the upper surface of the lock fitting 31.

In the lock mechanism 24 having such a configuration, when the unlocking force F13 is not applied by the unlocking mechanism 13, the lock fittings 30 and 31 are brought into the close contact state, and the tip end portion of the lead wire 4 exposed to the outside is sandwiched by the lock fittings 30 and 31 to be grasped and fixed. That is, the lead wire 4 is grasped and fixed by the lock mechanism 24, in a state of protruding from the winding region 10*w* by a specified amount.

Whereas, when the unlocking force F13 is applied to a part of the lock fitting 30 by the unlocking mechanism 13, the lock fittings 30 and 31 are brought into the space forming state, and the tip end portion of the lead wire 4 exposed to the outside is released. That is, the lead wire 4 is brought into a released state of being able to be pulled out from the lead wire storage mechanism 101.

Thus, depending on presence or absence of the unlocking force F13 from the unlocking mechanism 13, the lock mechanism 24 can switch between fixing and releasing of the tip end portion of the lead wire 4 exposed to the outside, via the lock fittings 30 and 31.

Returning to FIGS. 1A and 1B, the lead wire storage mechanism 101 further includes the remaining amount detector 16, which is a separate member from the lead cassette 10, and the remaining amount detector 16 detects presence or absence of the lead wire remaining amount shortage state in which a remaining amount of the lead wire 4 in the winding region 10*w* is equal to or less than a reference amount.

That is, the remaining amount detector 16 detects a remaining amount of the lead wire 4 wound around the support shaft 22 in the winding region 10*w*, compares the detected remaining amount with a reference amount, detects presence or absence of lead wire remaining amount shortage state in which the remaining amount of the lead wire 4 is equal to or less than the reference amount, and outputs the remaining amount detection signal S16 indicating presence or absence of the lead wire remaining amount shortage state, to the control unit 105.

Therefore, by outputting the remaining amount detection signal S16 indicating occurrence of the lead wire remaining amount shortage state from the remaining amount detector 16 to the control unit 105, replacement of the lead cassette 10 in use to a new lead cassette 10 can be prompted.

Note that, as a specific example of the remaining amount detector 16, for example, a reflection laser length measuring apparatus can be considered. The reflection laser length measuring apparatus can detect, as a detection distance, a distance to an outermost periphery of the wound lead wire 4 that becomes an obstacle, and can detect the remaining amount of the lead wire 4 on the basis of this detection distance.

For example, in a case where the remaining amount of the lead wire 4 is "0", the remaining amount detector 16 detects, as a detection distance, a support shaft reaching distance that is a distance from the remaining amount detector 16 to the support shaft 22, since there is no obstacle up to the support shaft 22. Therefore, in a case where the reference amount is "0", when the detection distance detected by the remaining amount detector 16 coincides with the support shaft reaching distance, it is possible to detect occurrence of the lead wire remaining amount shortage state.

Thus, by having a measurement function for the distance up to the nearest obstacle, the remaining amount detector 16 can detect presence or absence of the lead wire remaining amount shortage state, and output the remaining amount detection signal S16 indicating presence or absence of the lead wire remaining amount shortage state. Further, the remaining amount detector 16 may be a detector having a color recognition function that can visually recognize the support shaft 22, in a case where the reference amount is set to "0".

Figure 5:
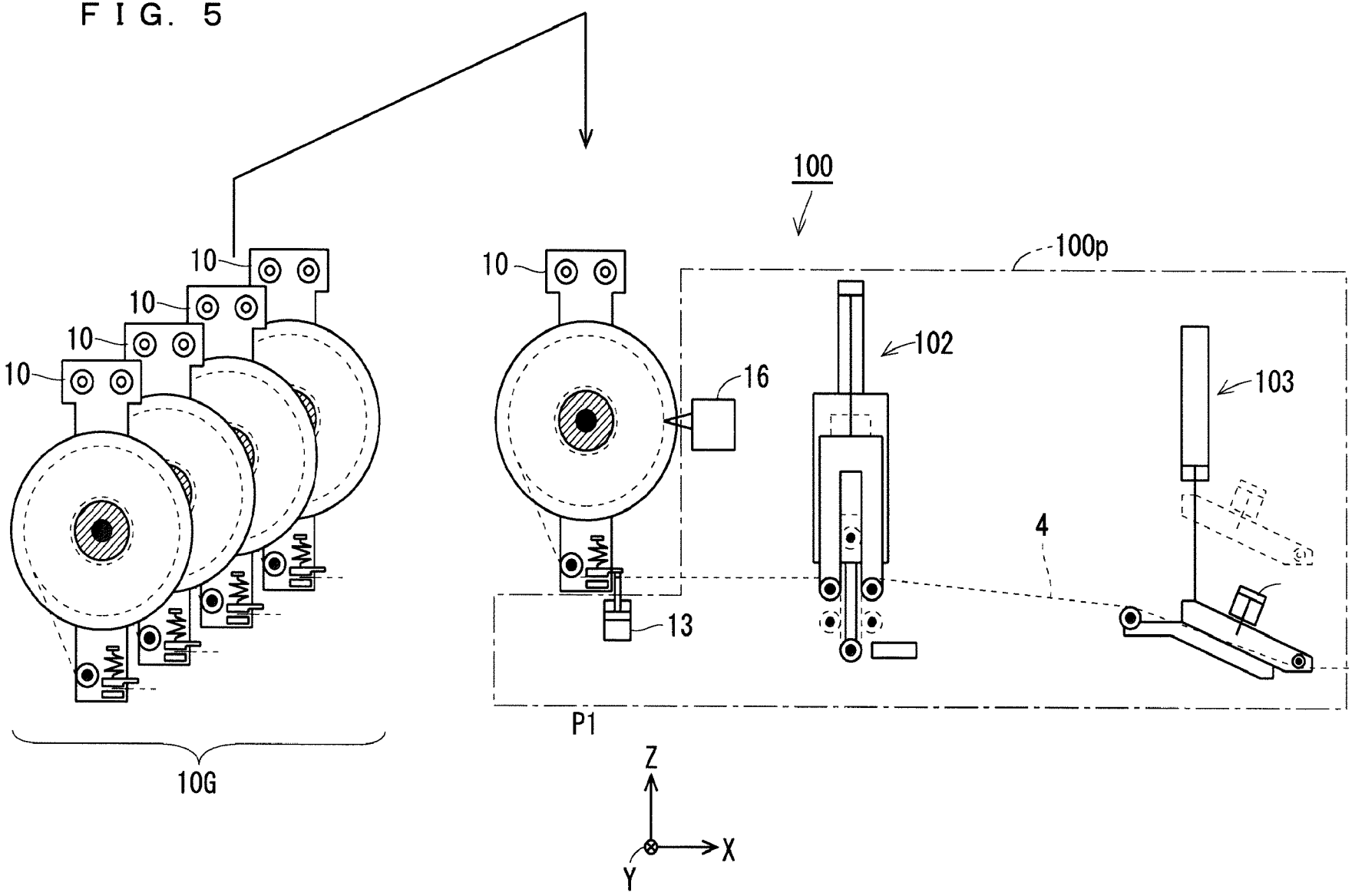
FIG. 5 is an explanatory view schematically showing a replacement state of the lead cassette shown in FIG. 3.

FIG. 5 is an explanatory view schematically showing a replacement state of the lead cassette 10, with use of the remaining amount detector 16. In FIG. 5, a component part excluding the lead cassette 10 from the lead wire pulling out mechanism 100 is shown as a fixed component part 100*p*.

As shown in the figure, a replacement lead cassette group 10G made up of a plurality of lead cassettes 10 is prepared in advance. Regarding the lead cassette 10 currently in use of the lead wire pulling out mechanism 100 (hereinafter abbreviated as "old lead cassette 10"), consider a case where the remaining amount detection signal S16 indicating occurrence of the lead wire remaining amount shortage state is outputted by the remaining amount detector 16.

In this case, first, the old lead cassette 10 is removed from the fixed component part 100*p* of the lead wire pulling out mechanism 100. At this time, the unlocking mechanism 13 and the remaining amount detector 16 continuously remain as the fixed component part 100*p*.

Then, one lead cassette 10 from the replacement lead cassette group 10G is selected as a lead cassette 10 that is new (hereinafter abbreviated as "new lead cassette 10"), the new lead cassette 10 is mounted to the fixed component part 100*p*, and the lead wire pulling out mechanism 100 is reconstructed.

Thus, when the remaining amount detector 16 outputs the remaining amount detection signal S16 indicating the lead wire remaining amount shortage state in the old lead cassette 10, the old lead cassette 10 can be quickly replaced with the new lead cassette 10.

Further, the two guide holes 21 provided in the bracket 20 of each of the plurality of lead cassettes 10 in the replacement lead cassette group 10G are accurately provided without being misaligned between the plurality of lead cassettes 10. Accordingly, the two guide holes 21 serve as reference holes for positioning the lead cassette 10.

Specifically, by grasping the bracket 20 of the new lead cassette 10 at an accurate grasping position with the two guide holes 21 as a reference, it is possible to mount the lead cassette 10 to the fixed component part 100*p* such that the tip end portion (the lock mechanism 24) of the lead wire 4 is accurately positioned at an initial position P1. Therefore, a positional relationship of the remaining amount detector 16 and the unlocking mechanism 13 with respect to the new lead cassette 10 is to be also the same as a positional relationship of the remaining amount detector 16 and the unlocking mechanism 13 with respect to the old lead cassette 10.

In this way, by using the two guide holes 21 as reference holes, the new lead cassette 10 can be accurately positioned and mounted to the fixed component part 100*p* at the time of replacing the old lead cassette 10 with the new lead cassette 10.

By using a cassette grasping mechanism and a cassette mounting mechanism that are not shown and executable under control of the control unit 105, to execute a grasping operation with the bracket 20 and a mounting operation of the new lead cassette 10 to the fixed component part 100*p*, the replacement process from the old lead cassette 10 to the new lead cassette 10 described above can be automated.

Returning to FIGS. 1A and 1B, the tension adjusting mechanism 102 includes a dancer roller 7, two lifting and lowering guide rollers 11, and the breakage detector 17 as main components. The dancer roller 7 can move along a vertical movement direction V7 (±Z direction), and the two lifting and lowering guide rollers 11 can move along a vertical movement direction V11 (±Z direction). The dancer roller 7 and the two lifting and lowering guide rollers 11 serve as at least one roller included in the tension adjusting mechanism 102.

Note that, actually, as shown in FIGS. 1A and 1B, the dancer roller 7 is mounted to a mounting jig 7*j*, and the two lifting and lowering guide rollers 11 are mounted to the mounting jig 11*j*. However, in the following, for convenience of description, the dancer roller 7 and the mounting jig 7*j* may be simply referred to as "dancer roller 7" inclusively, and the two lifting and lowering guide rollers 11 and the mounting jig 11*j* may be simply referred to as "lifting and lowering guide roller 11" inclusively.

The dancer roller 7 is positioned above a hand travel space 50 described later in a preparation state (first preparation state) as indicated by a broken line, and is positioned below the hand travel space 50 in an actual operation state (first actual operation state) as indicated by a solid line.

The lifting and lowering guide roller 11 is positioned below the hand travel space 50 in the preparation state (first preparation state) as indicated by a broken line, and is positioned inside the hand travel space 50 in the actual operation state (first actual operation state) as indicated by a solid line.

Therefore, the tension adjusting mechanism 102 having the dancer roller 7 and the two lifting and lowering guide rollers 11 as at least one roller is formed with a partial space (first partial space) that is to be a part of the hand travel space 50 at the time of the preparation state.

Whereas, in the actual operation state, by an upper outer peripheral surface of the lifting and lowering guide roller 11 and the lead wire 4 being in contact with each other, and a lower outer peripheral surface of the dancer roller 7 and the lead wire 4 being in contact with each other, the tension adjusting mechanism 102 can perform a tension adjustment process so as to keep the tension applied to the lead wire 4 constant.

Thus, in the tension adjusting mechanism 102, a state changes between the preparation state (first preparation state) of forming a partial space (first partial space) that is to be a part of the hand travel space 50, and the actual operation state (first actual operation state) in which the tension adjustment process described above can be executed.

Further, the tension adjusting mechanism 102 includes the breakage detector 17 that detects presence or absence of disconnection of the lead wire 4 when the tension adjustment process described above is being executed in the actual operation state. The breakage detector 17 is arranged in the vicinity of a lowest possible position of descending of the dancer roller 7 in the actual operation state.

A detection principle by the breakage detector 17 is as follows. When the lead wire 4 is disconnected, the tension due to the lead wire 4 is lost, so that the dancer roller 7 descends to the lowest possible position of descending. Therefore, the breakage detector 17 can detect occurrence of the disconnection state of the lead wire 4 by detecting that the dancer roller 7 has descended to the lowest possible position of descending.

As a result, the dancer roller 7 can output the breakage detection signal S17 indicating presence or absence of disconnection of the lead wire 4, to the control unit 105.

Note that, as specific examples of the breakage detector 17, a position detector, a reed switch, a limit switch, a contact switch, and the like can be considered.

The lead wire guide mechanism 103 includes an opening and closing lead guide 12, a fixed lead guide 70, a lead guide lifting and lowering cylinder 71, and a lead grasping cylinder 72 as main components.

The opening and closing lead guide 12 can be moved in a vertical movement direction V12 (±Z direction) by the lead guide lifting and lowering cylinder 71. Whereas, the fixed lead guide 70 is fixedly arranged by fixing means (not shown).

In a case where the opening and closing lead guide 12 exists on a lower side as indicated by a solid line, the lead wire 4 can be gently grasped such that the lead wire 4 can move, by the lead grasping cylinder 72 forming a minute space between a lower surface of the opening and closing lead guide 12 and an upper surface of the fixed lead guide 70. Therefore, the lead wire 4 can pass through the minute space described above.

Note that a guide roller 73 is provided to the fixed lead guide 70 on an input side of the minute space described above, and a guide roller 74 is provided to the opening and closing lead guide 12 on an output side of the minute space described above. The guide rollers 73 and 74 are provided in order to smoothly move the lead wire 4 before and after the minute space described above.

The opening and closing lead guide 12 is as indicated by a broken line in a preparation state (second preparation state). A position is made above the hand travel space 50 by being moved upward by the lead guide lifting and lowering cylinder 71, and the minute space described above is formed between with the fixed lead guide 70 below the hand travel space 50 in an actual operation state (second actual operation state) as indicated by the solid line.

Accordingly, the lead wire guide mechanism 103 having the opening and closing lead guide 12 is formed with a partial space (second partial space) that is to be a part of the hand travel space 50 in the preparation state.

Whereas, in the actual operation state, by forming the minute space described above between the opening and closing lead guide 12 and the fixed lead guide 70, the lead wire guide mechanism 103 can perform a guide process for guiding the lead wire 4 downward by passing the lead wire 4 through the minute space described above.

Thus, in the lead wire guide mechanism 103, a state changes between the preparation state (second preparation state) of forming a partial space (second partial space) that is to be a part of the hand travel space 50, and the actual operation state (second actual operation state) in which the guide process described above can be executed.

The lead wire grasping and moving mechanism 104 includes a lifting and lowering hand unit 15 and a horizontal direction transfer machine 14 as main components.

The horizontal direction transfer machine 14 has a predetermined thickness (a length in the Z direction) and a predetermined width (a length in the Y direction), and is provided extending in a horizontal direction (X direction).

The lifting and lowering hand unit 15 has a grasping part 62*g* at a tip end. The grasping part 62*g* can perform a grasping operation for grasping the lead wire 4 in accordance with an opening and closing operation OP15.

The lifting and lowering hand unit 15 is mounted to the horizontal direction transfer machine 14 so as to be movable between the initial position P1 and a target position P2 along a horizontal movement direction H14 (±X direction). Therefore, the lifting and lowering hand unit 15 can perform a grasping part moving operation for moving in the horizontal movement direction H14 while the lead wire 4 is grasped by the grasping part 62*g*. Further, the lifting and lowering hand unit 15 can also move along a vertical movement direction V15 (±Z direction).

Figure 6:
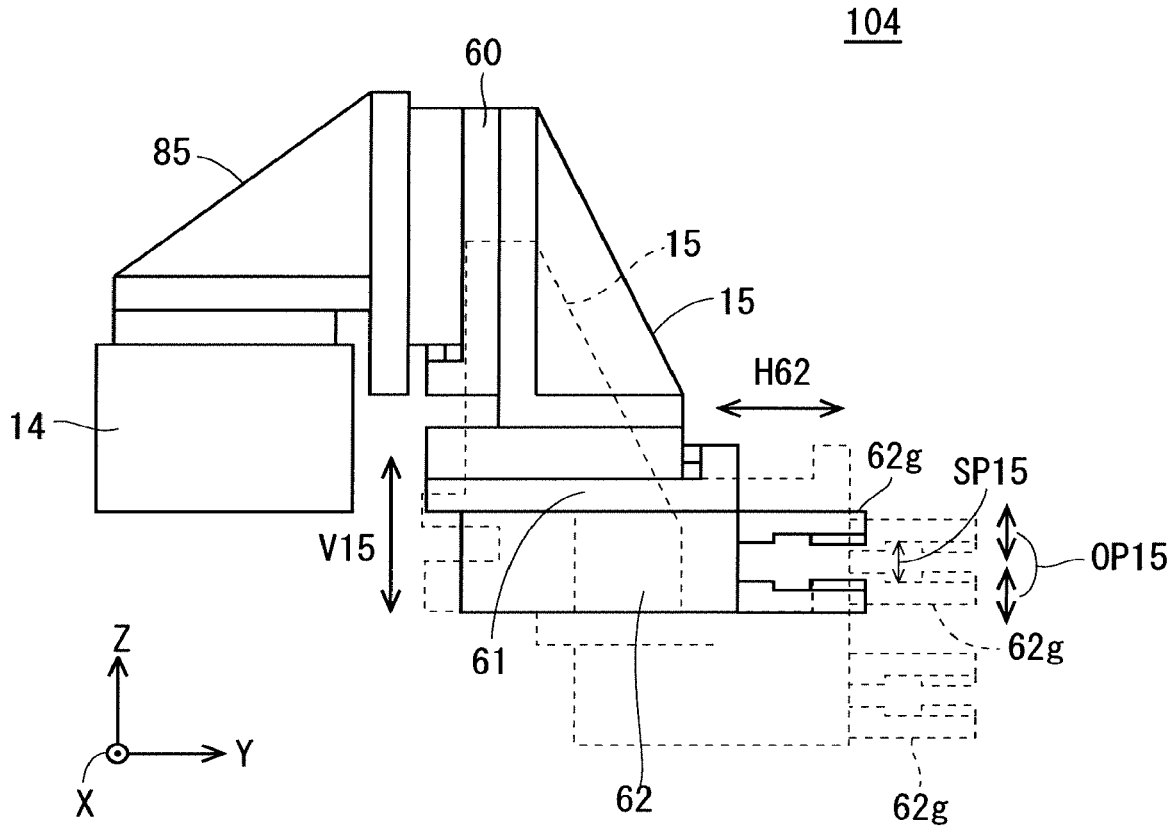
FIG. 6 is an explanatory view showing details of a lead wire grasping and moving mechanism shown in FIGS. 1A and 1B.

FIG. 6 is an explanatory view showing a detailed structure of the lead wire grasping and moving mechanism 104 shown in FIGS. 1A and 1B. Note that the horizontal direction transfer machine 14 and the lifting and lowering hand unit 15 (grasping part 62*g*) shown in FIGS. 1A and 1B are schematically shown, and an actual shape is similar to the structure shown in FIG. 6.

As shown in FIG. 6, the horizontal direction transfer machine 14 is fixedly arranged at a position (+Z direction side) higher than the grasping part 62*g* by fixing means (not shown).

The lifting and lowering hand unit 15 is mounted to the horizontal direction transfer machine 14 via a hand unit mounting jig 85 and a vertical slide table 60. The vertical slide table 60 is mounted to the hand unit mounting jig 85 so as to be movable in the vertical movement direction V15 (±Z direction), and the lifting and lowering hand unit 15 is provided integrally with the vertical slide table 60.

Therefore, the lifting and lowering hand unit 15 can move in the vertical movement direction V15 (±Z direction) together with the vertical slide table 60 in a state in which the hand unit mounting jig 85 is fixed.

A chucking hand 62 is mounted below the lifting and lowering hand unit 15 via a horizontal slide table 61, and a tip end of the chucking hand 62 on a right side (+Y direction) serves as the grasping part 62*g*. The horizontal slide table 61 is mounted to the lifting and lowering hand unit 15 so as to be movable in a horizontal movement direction H62, and the chucking hand 62 is provided integrally with the horizontal slide table 61.

Therefore, the chucking hand 62 can move in the horizontal movement direction H62 (±Y direction) together with the horizontal slide table 61 in a state in which the lifting and lowering hand unit 15 is stopped.

The end portion of the chucking hand 62 on the right side (+Y direction) serves as the grasping part 62*g*. The grasping part 62*g* can perform the grasping operation for grasping the lead wire 4 by the grasping part 62*g*, through the opening and closing operation OP15 by an upper grasping member and a lower grasping member.

As described above, the lead wire grasping and moving mechanism 104 has the grasping part 62*g*, and can execute the grasping operation for grasping the tip end portion of the lead wire 4 by the grasping part 62*g*.

Furthermore, by matching an arrangement height of the grasping part 62*g* with the hand travel space 50 that is the lead wire movement space, the lead wire grasping and moving mechanism 104 can further execute the grasping part moving operation for moving the grasping part 62*g* from the initial position P1 to the target position P2 through the hand travel space 50.

(Lead Wire Pulling Out Initial Setting Process)

Regarding the lead wire pulling out initial setting process, for example, an output of the remaining amount detection signal S16 indicating the lead wire remaining amount shortage state by the remaining amount detector 16, an output of the breakage detection signal S17 indicating disconnection of the lead wire 4 by the breakage detector 17, or an output of the execution request signal S20 according to an operator's request becomes an execution start condition.

As shown in FIG. 2, since the remaining amount detection signal S16, the breakage detection signal S17, and the execution request signal S20 are inputted, the control unit 105 can start execution control of the lead wire pulling out initial setting process when the execution start condition described above is satisfied.

The lead wire pulling out initial setting process executed under control of the control unit 105 includes the following steps (a) to (e).

Step (a) is a step of causing a tip end portion of the lead wire 4 stored in the lead wire storage mechanism 101 (winding region 10*w*) to be grasped, by causing the lead wire grasping and moving mechanism 104 to execute the grasping operation at the initial position P1.

Step (b) is a step of setting the tension adjusting mechanism 102 to the preparation state (first preparation state) and setting the lead wire guide mechanism 103 to the preparation state (second preparation state).

Step (c) is a step of moving the grasping part 62*g* to the target position P2, by causing the lead wire grasping and moving mechanism 104, in which the grasping part 62*g* is executing the grasping operation at the initial position P1, to further execute the grasping part moving operation.

By this step (c), after passing through the hand travel space 50 (lead wire movement space) including the first and second partial spaces described above, the tip end portion of the lead wire 4 grasped by the grasping part 62*g* is guided to the target position P2 together with the grasping part 62*g*, and the grasping part moving operation is ended after the execution of this step (c).

Step (d) is a step that is executed after step (c), and is for setting the tension adjusting mechanism 102 to the actual operation state (first actual operation state) and setting the lead wire guide mechanism 103 to the actual operation state (second actual operation state).

Step (e) is a step that is executed after step (c), and is for ending the grasping operation by the grasping part 62*g*, and releasing the lead wire 4 from the lead wire grasping and moving mechanism 104.

FIGS. 7A and 7B to 21 are explanatory views showing an operation content of the lead wire pulling out initial setting process. FIGS. 7A and 7B to 12A and 12B schematically show the lead wire pulling out initial setting process, and are figures in plan view in the XZ plane similarly to FIGS. 1A and 1B. FIGS. 13 to 21 show the lead wire pulling out initial setting process in accordance with an actual structure as much as possible, and are figures in plan view in the YZ plane. Note that FIGS. 13 to 15 correspond to the A-A cross section of FIGS. 1A and 1B, FIGS. 16 to 18 correspond to the B-B cross section of FIGS. 1A and 1B, and FIGS. 19 to 21 correspond to the C-C cross section of FIGS. 1A and 1B.

Hereinafter, a processing content of the lead wire pulling out initial setting process described above performed under control of the control unit 105 will be described with reference to these drawings.

Figures 7A, 7B:
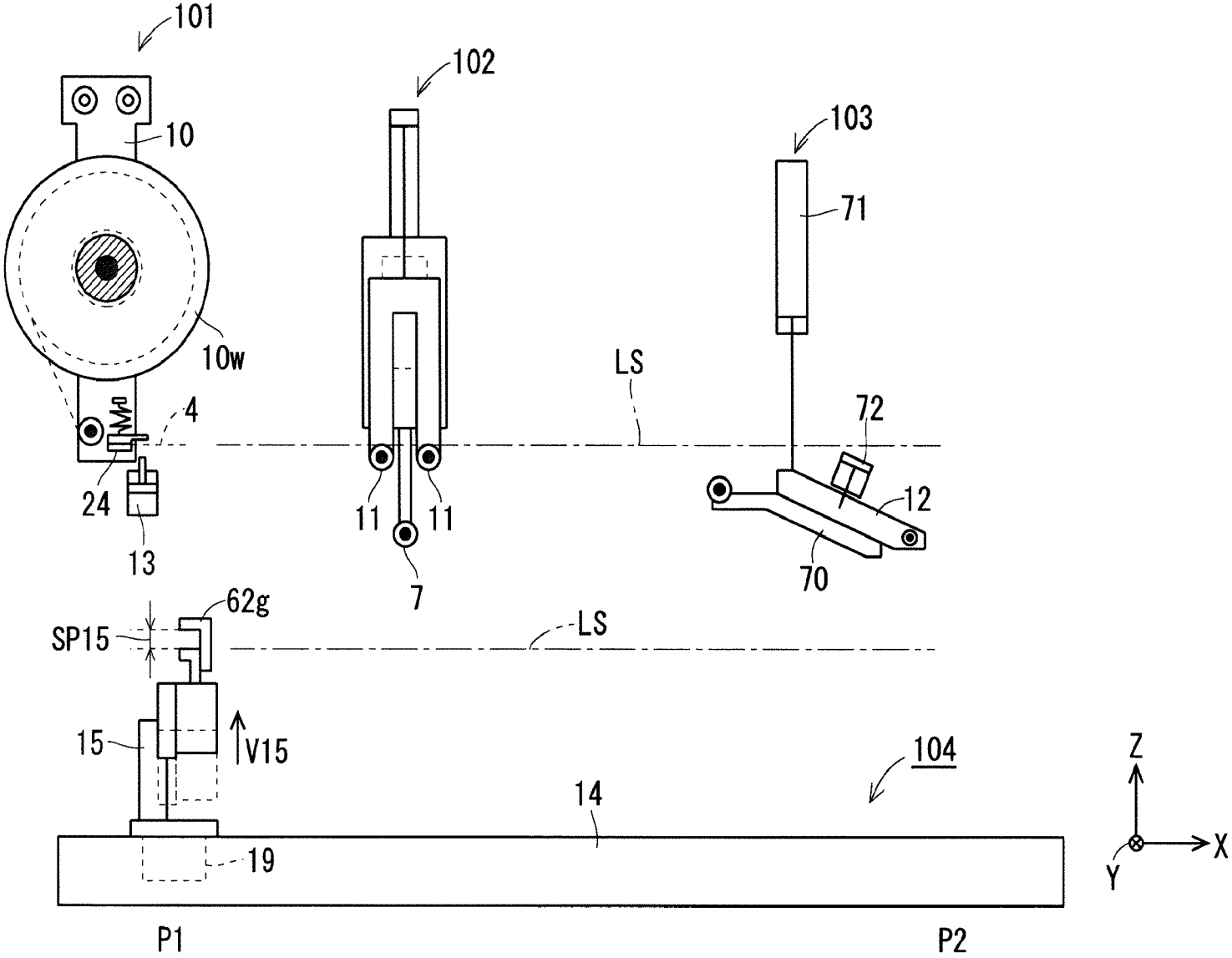
FIGS. 7A and 7B are explanatory views showing an operation content of a lead wire pulling out initial setting process.

As shown in FIGS. 7A and 7B, the lead wire storage mechanism 101, the tension adjusting mechanism 102, the lead wire guide mechanism 103, and the lead wire grasping and moving mechanism 104 are individually set to an initial state. That is, FIGS. 7A and 7B show a state immediately before execution of the lead wire pulling out initial setting process described above.

Figure 14:
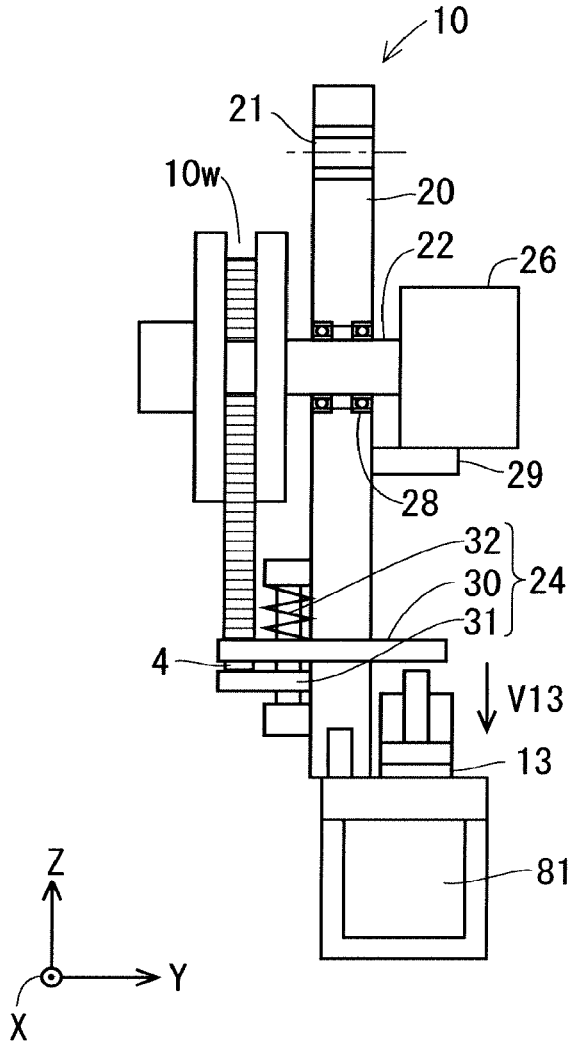
FIG. 14 is an explanatory view showing an operation content of the lead wire pulling out initial setting process.

As shown in FIGS. 7A and 14, in the initial state, the lead wire 4 is fixed by the lock mechanism 24 in a fixed state with a tip end portion protruding from the lock mechanism 24. This state is a lead wire fixed state. That is, in the lead wire fixed state, the unlocking force F13 from the unlocking mechanism 13 is not applied to the lock mechanism 24.

Note that, in FIGS. 7A and 7B to 13, a virtual line extending in a horizontal direction (in the X direction) from the lead wire 4 fixed by the lock mechanism 24 is shown as a drawing reference line LS.

In each of FIGS. 7A, 8A, 9A, 10A and 11A, the lead wire storage mechanism 101, the tension adjusting mechanism 102, and the lead wire guide mechanism 103 are shown, and in each of FIGS. 7B, 8B, 9B, 10B and 11B the lead wire grasping and moving mechanism 104 is shown. In order to make an index of a correlation positional relationship in a vertical direction (Z direction) between FIGS. 7A and 7B, 8A and 8B, 9A and 9B. 10A and 10B, and 11A and 11B, the common drawing reference line LS is shown in each of FIGS. 7A to 11A and FIGS. 7B to 11B.

Figure 13:
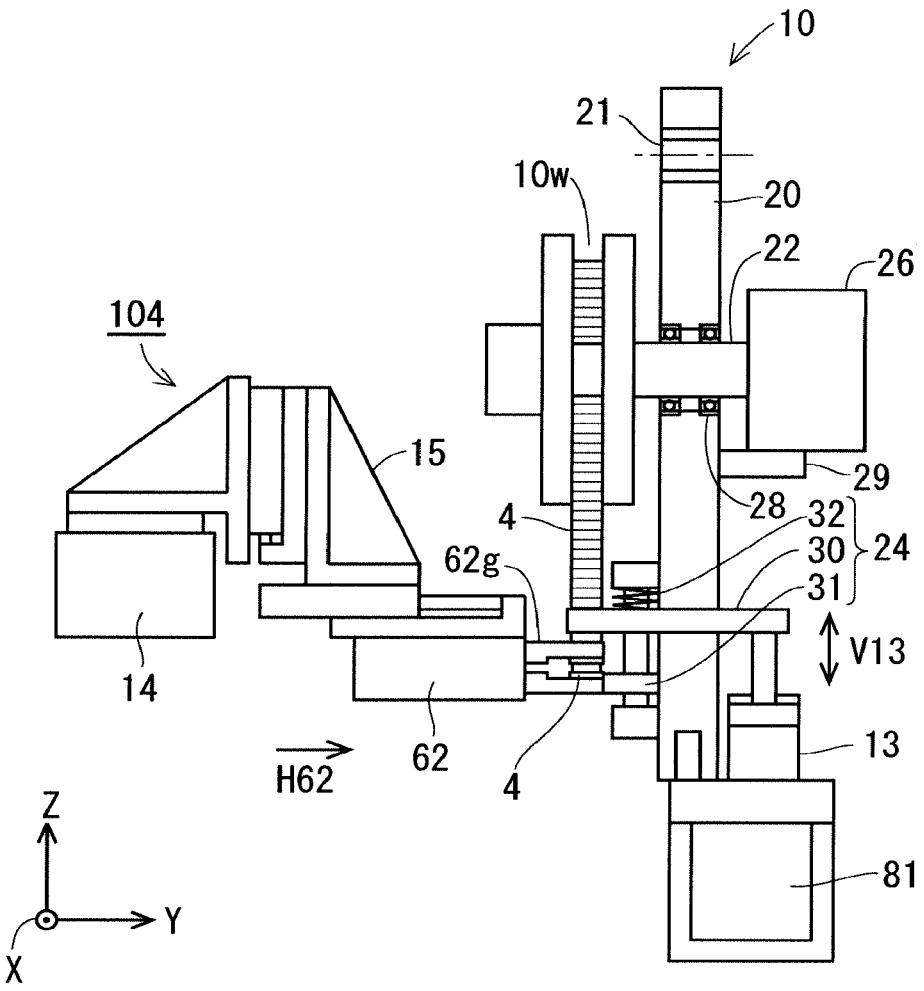
FIG. 13 is an explanatory view showing an operation content of the lead wire pulling out initial setting process.
Figure 15:
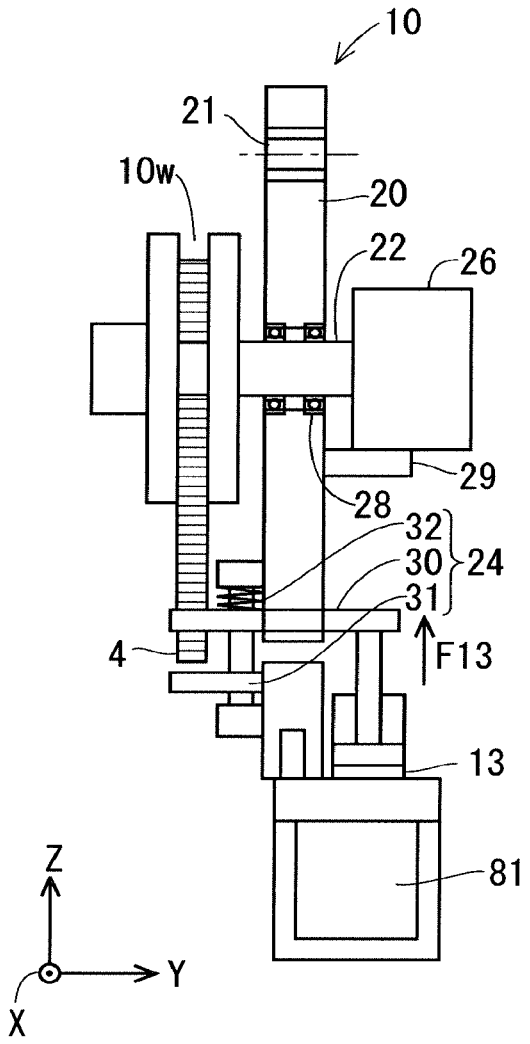
FIG. 15 is an explanatory view showing an operation content of the lead wire pulling out initial setting process.

Note that, as shown in FIGS. 13 to 15, the lead cassette 10 is provided on an upper surface of a machine frame 81, and the unlocking mechanism 13 is provided adjacent to the lead cassette 10 on the upper surface of the machine frame 81. Further, the tension-variable support shaft 22 is rotatably mounted to a support shaft base 26, and provided extending to the winding region 10*w* through a bearing 28 provided in an opening part of the bracket 20. The support shaft base 26 is fixed to the bracket 20 via a mounting jig 29 provided on a side surface of the bracket 20.

As shown in FIG. 7B, the lifting and lowering hand unit 15 of the lead wire grasping and moving mechanism 104 lifts the grasping part 62*g* in the vertical movement direction V15 (+Z direction), in the initial state, such that an arrangement height of the grasping part 62*g* is positioned at the drawing reference line LS. Note that the grasping part 62*g* executes the opening and closing operation OP15 such that a grasp release space SP15 is provided, in the initial state.

Note that the lifting and lowering hand unit 15 has a hand unit moving body 19 below, and a moving operation of the grasping part 62*g* in a horizontal direction is enabled by this the hand unit moving body 19 moving in the horizontal direction (X direction) within the horizontal direction transfer machine 14.

As shown in FIG. 7A, in the initial state, the tension adjusting mechanism 102 is arranged such that the dancer roller 7 is positioned below the drawing reference line LS, while the lifting and lowering guide roller 11 is positioned in the vicinity below the drawing reference line LS.

As shown in FIG. 7A, in the initial state, the lead wire guide mechanism 103 is arranged such that the opening and closing lead guide 12 is positioned below the drawing reference line LS by the lead guide lifting and lowering cylinder 71.

Figures 8A, 8B:
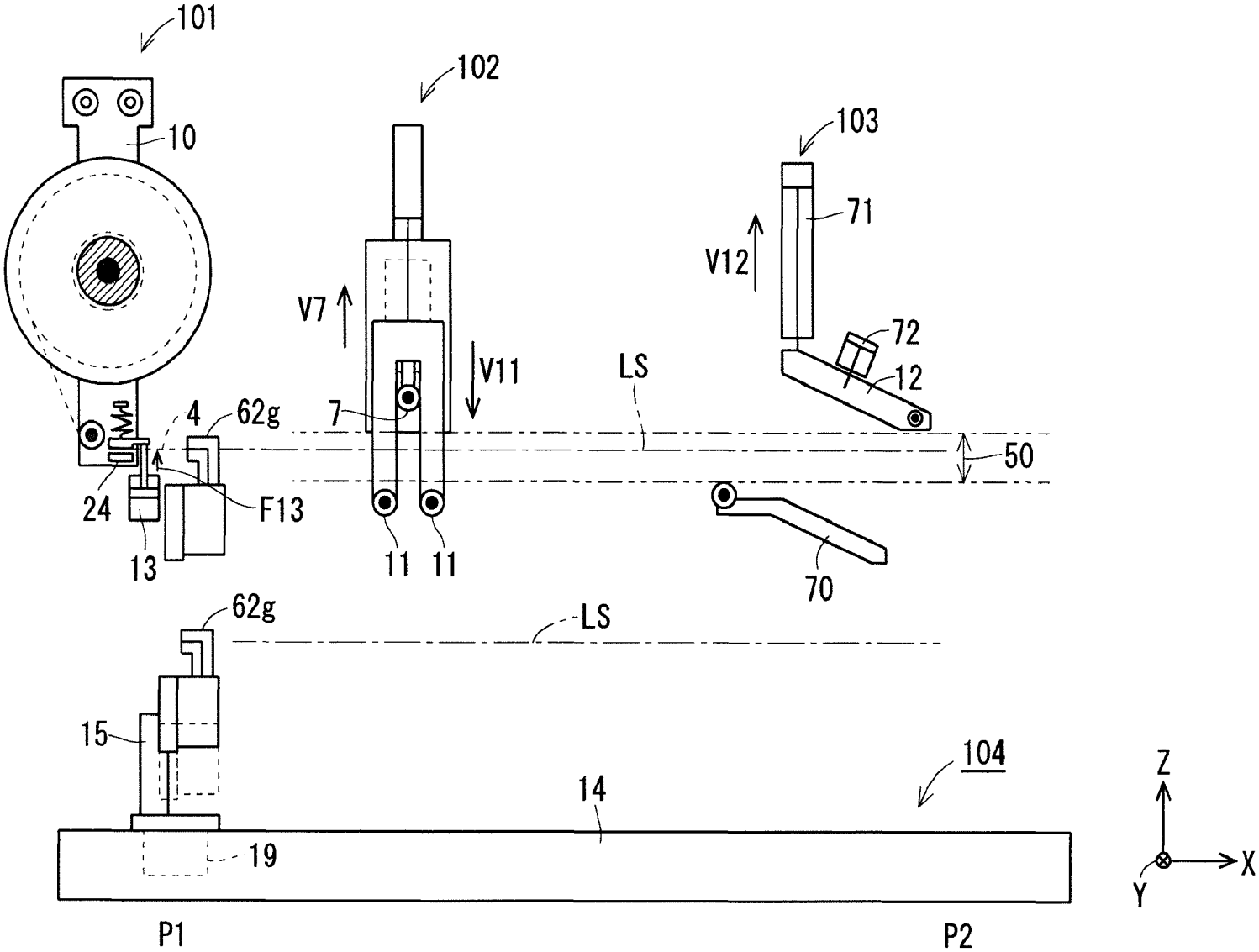
FIGS. 8A and 8B are explanatory views showing an operation content of the lead wire pulling out initial setting process.

FIGS. 8A and 8B show a state in which a process corresponding to steps (a) and (b) of the lead wire pulling out initial setting process described above is executed.

As shown in FIGS. 8A 8B and 13, the chucking hand 62 is moved horizontally from the initial state along the horizontal movement direction H62 (+Y direction), and the grasping part 62*g* is moved to a position where the tip end portion of the lead wire 4 can be grasped. That is, the chucking hand 62 is moved to a state in which the tip end portion of the lead wire 4 exists in the grasp release space SP15 (see FIG. 6) of the grasping part 62*g*.

By closing the grasp release space SP15 in this state, the grasping operation for grasping the tip end portion of the lead wire 4 is executed by the grasping part 62*g*.

When the grasping operation by the grasping part 62*g* is completed, as shown in FIGS. 8A and 15, the grasping and fixing of the lead wire 4 by the lock mechanism 24 is released by applying the unlocking force F13 from the unlocking mechanism 13 to the lock mechanism 24, and the lead wire 4 is brought into a lead wire released state. That is, in the lead wire released state, the lead wire 4 is brought into a state of being free from the lead wire storage mechanism 101.

Thus, by causing the lead wire grasping and moving mechanism 104 to execute the grasping operation at the initial position P1, the process corresponding to the step (a) for grasping the tip end portion of the lead wire 4 stored in the lead wire storage mechanism 101 is executed.

Figure 18:
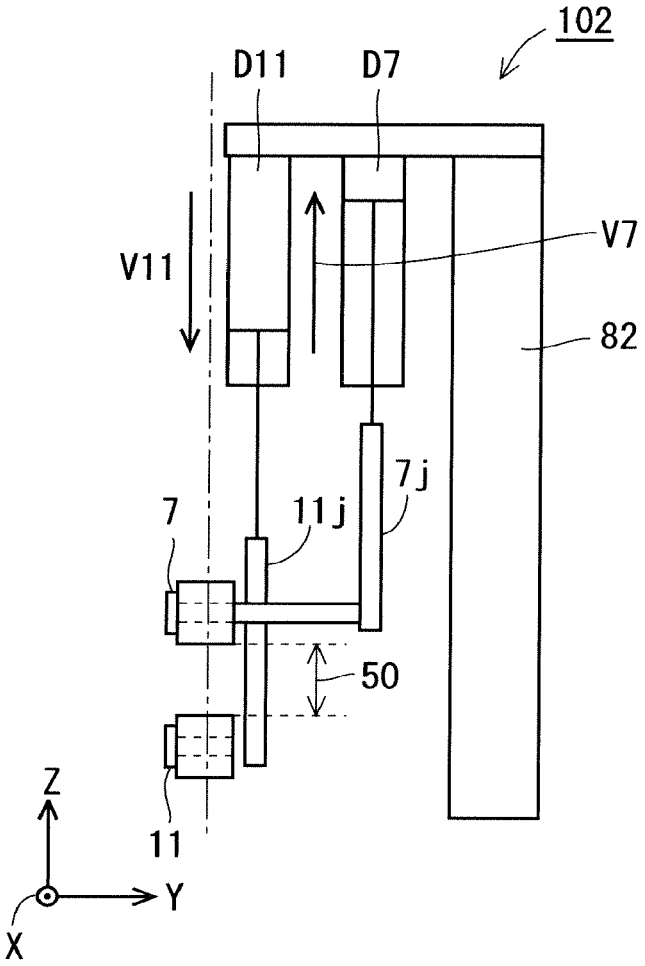
FIG. 18 is an explanatory view showing an operation content of the lead wire pulling out initial setting process.

As shown in FIGS. 8A and 18, the tension adjusting mechanism 102 is set to the preparation state (first preparation state). That is, the lifting and lowering guide roller 11 is lowered from the initial state along the vertical movement direction V11 (−Z direction) by a lifting and lowering driving part D11, and the dancer roller 7 is lifted from the initial state along the vertical movement direction V7 (+Z direction) by a lifting and lowering driving part D7. Note that, for example, a cylinder can be considered as the lifting and lowering driving part D11 and the lifting and lowering driving part D7.

In the tension adjusting mechanism 102, in the preparation state, the lifting and lowering guide roller 11 is positioned below the drawing reference line LS while the dancer roller 7 is positioned above the drawing reference line LS, which secures a partial space (first partial space) that is to be a part of the hand travel space 50 between the dancer roller 7 and the lifting and lowering guide roller 11. That is, neither the lifting and lowering guide roller 11 nor the dancer roller 7 exists in the hand travel space 50 including the partial space described above.

Figure 21:
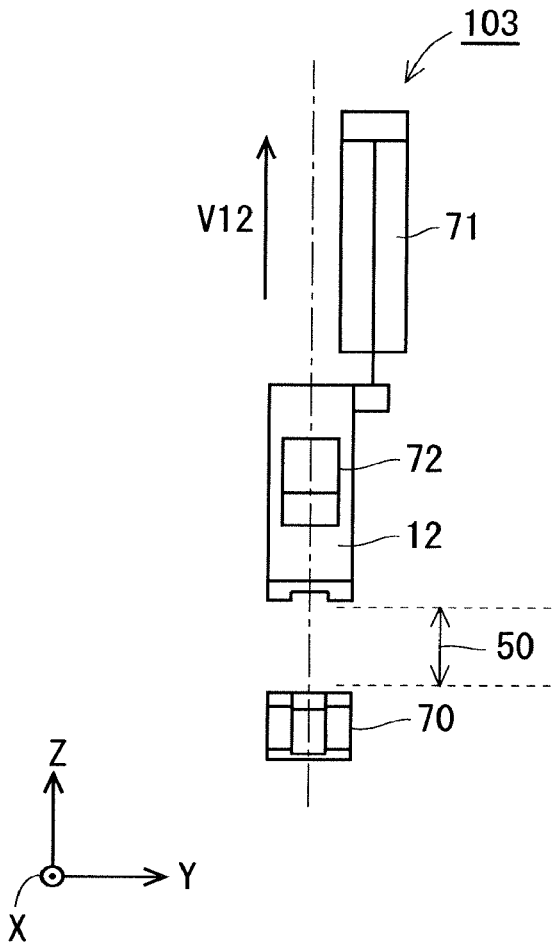
FIG. 21 is an explanatory view showing an operation content of the lead wire pulling out initial setting process.

As shown in FIGS. 8A and 21, the lead wire guide mechanism 103 is set to the preparation state (second preparation state). That is, the opening and closing lead guide 12 is lifted from the initial state along the vertical movement direction V12 (+Z direction) by the lead guide lifting and lowering cylinder 71.

In the lead wire guide mechanism 103, in the preparation state, the opening and closing lead guide 12 is positioned above the drawing reference line LS, which secures a partial space (second partial space) that is to be a part of the hand travel space 50 between the opening and closing lead guide 12 and the fixed lead guide 70. That is, neither the opening and closing lead guide 12 nor the fixed lead guide 70 exists in the hand travel space 50 including the partial space described above.

In this way, the process corresponding to step (b) for setting the tension adjusting mechanism 102 to the preparation state (first preparation state) and setting the lead wire guide mechanism 103 to the preparation state (second preparation state) is executed.

Figures 9A, 9B:
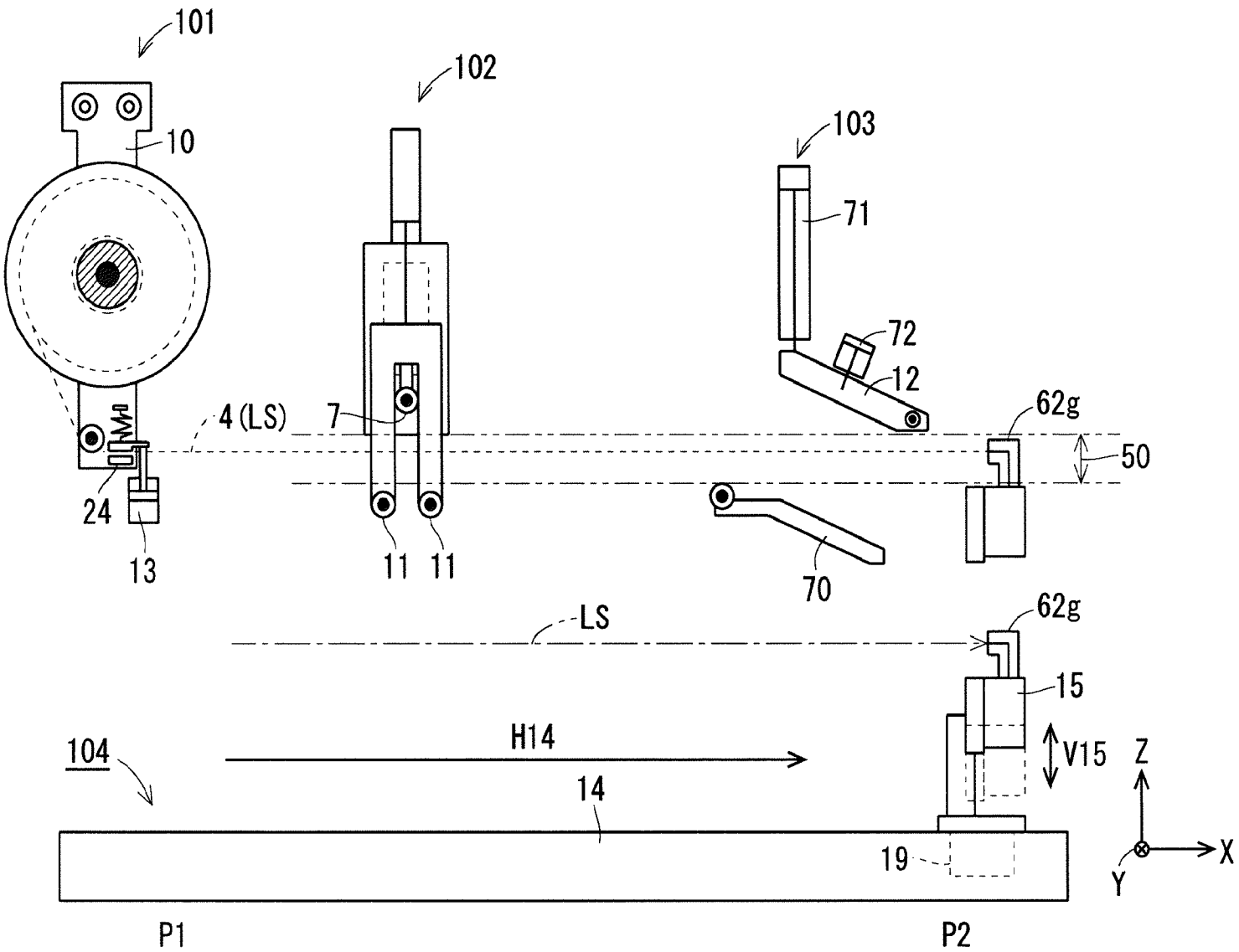
FIGS. 9A and 9B are explanatory views showing an operation content of the lead wire pulling out initial setting process.

FIGS. 9A and 9B show a state in which a process corresponding to step (c) of the lead wire pulling out initial setting process described above is executed.

In a stage before execution of the process corresponding to step (c), as shown in FIGS. 8A and 8B, at the initial position P1, the grasping part 62*g* of the lead wire grasping and moving mechanism 104 grasps the tip end portion of the lead wire 4 existing at the drawing reference line LS. That is, the grasping part 62*g* is arranged so as to be included in the hand travel space 50 in a height direction (Z direction).

Then, as shown in FIGS. 9A and 9B, there is executed the grasping part moving operation, which is for moving the lead wire grasping and moving mechanism 104 (grasping part 62*g*) that is executing the grasping operation described above, along the horizontal movement direction H14 (+X direction). As a result, the grasping part 62*g* can be moved from the initial position P1 to the target position P2 via the hand travel space 50.

Figure 16:
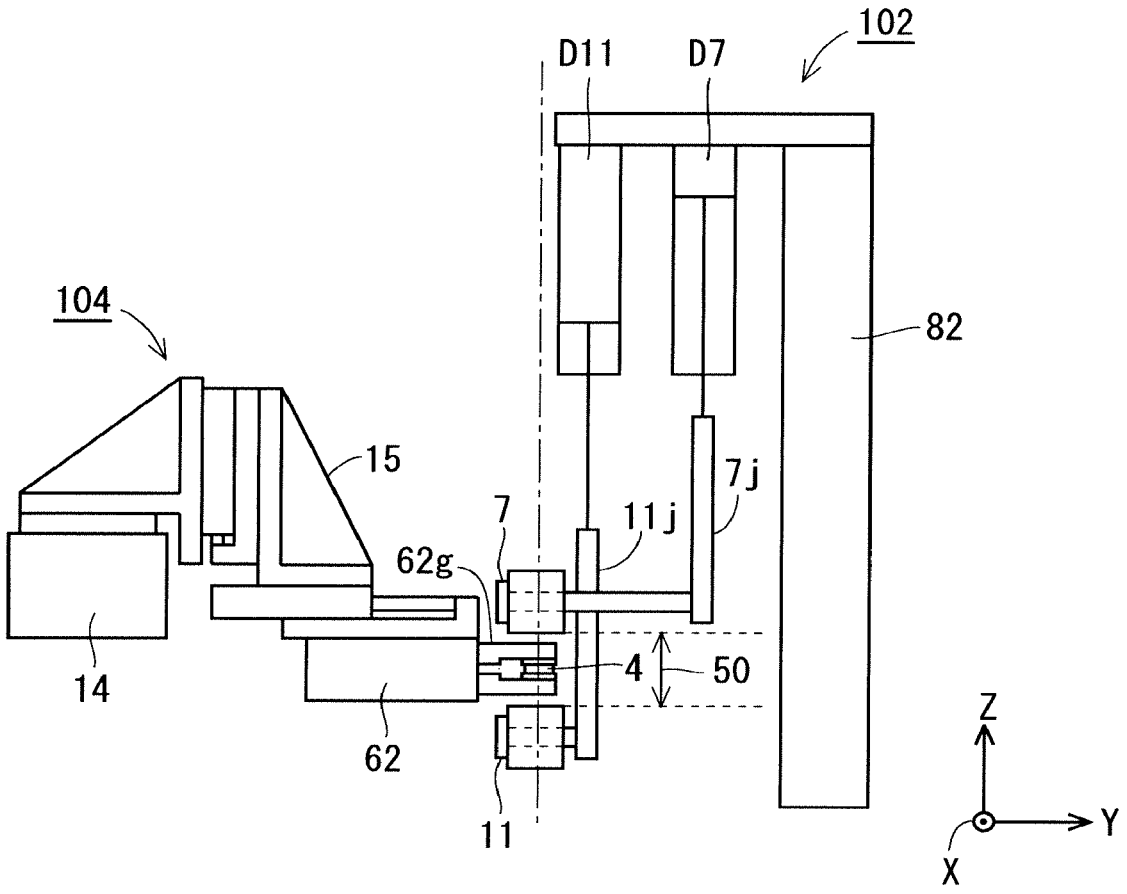
FIG. 16 is an explanatory view showing an operation content of the lead wire pulling out initial setting process.

As shown in FIG. 16, the tension adjusting mechanism 102 is formed with a partial space (first partial space) that is to be a part of the hand travel space 50 between the dancer roller 7 and the lifting and lowering guide roller 11. Therefore, when the grasping part moving operation described above is executed, the grasping part 62*g* can pass through the hand travel space 50 (first partial space) formed between the dancer roller 7 and the lifting and lowering guide roller 11 without any trouble.

Figure 19:
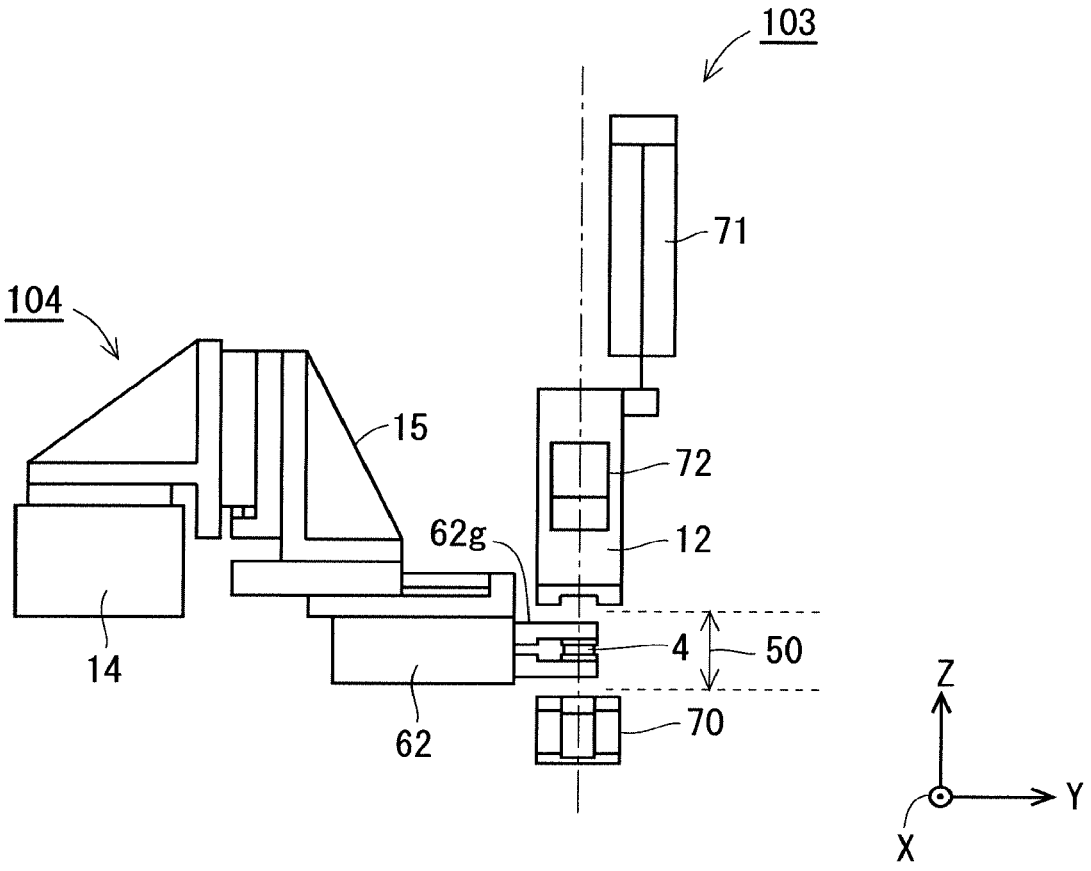
FIG. 19 is an explanatory view showing an operation content of the lead wire pulling out initial setting process.

Furthermore, as shown in FIG. 19, the lead wire guide mechanism 103 is formed with a partial space (second partial space) that is to be a part of the hand travel space 50 between the opening and closing lead guide 12 and the fixed lead guide 70. Therefore, when the grasping part moving operation described above is executed, the grasping part 62*g* can pass through the hand travel space 50 (second partial space) formed between the opening and closing lead guide 12 and the fixed lead guide 70 without any trouble.

Therefore, by executing the grasping part moving operation described above, the tip end portion of the lead wire 4 grasped by the grasping part 62*g* is guided to the target position P2 together with the grasping part 62*g* after passing through the hand travel space 50 (lead wire movement space) including the first and second partial spaces described above, and then the grasping part moving operation is ended.

In this way, the process corresponding to step (c) for causing the lead wire grasping and moving mechanism 104 to execute the grasping part moving operation is executed. Immediately after the execution of step (c), the lead wire 4 exists in the hand travel space 50, and overlaps with each of the dancer roller 7, the lifting and lowering guide roller 11, the opening and closing lead guide 12, and the fixed lead guide 70 in plan view in the XY plane.

Figures 10A, 10B:
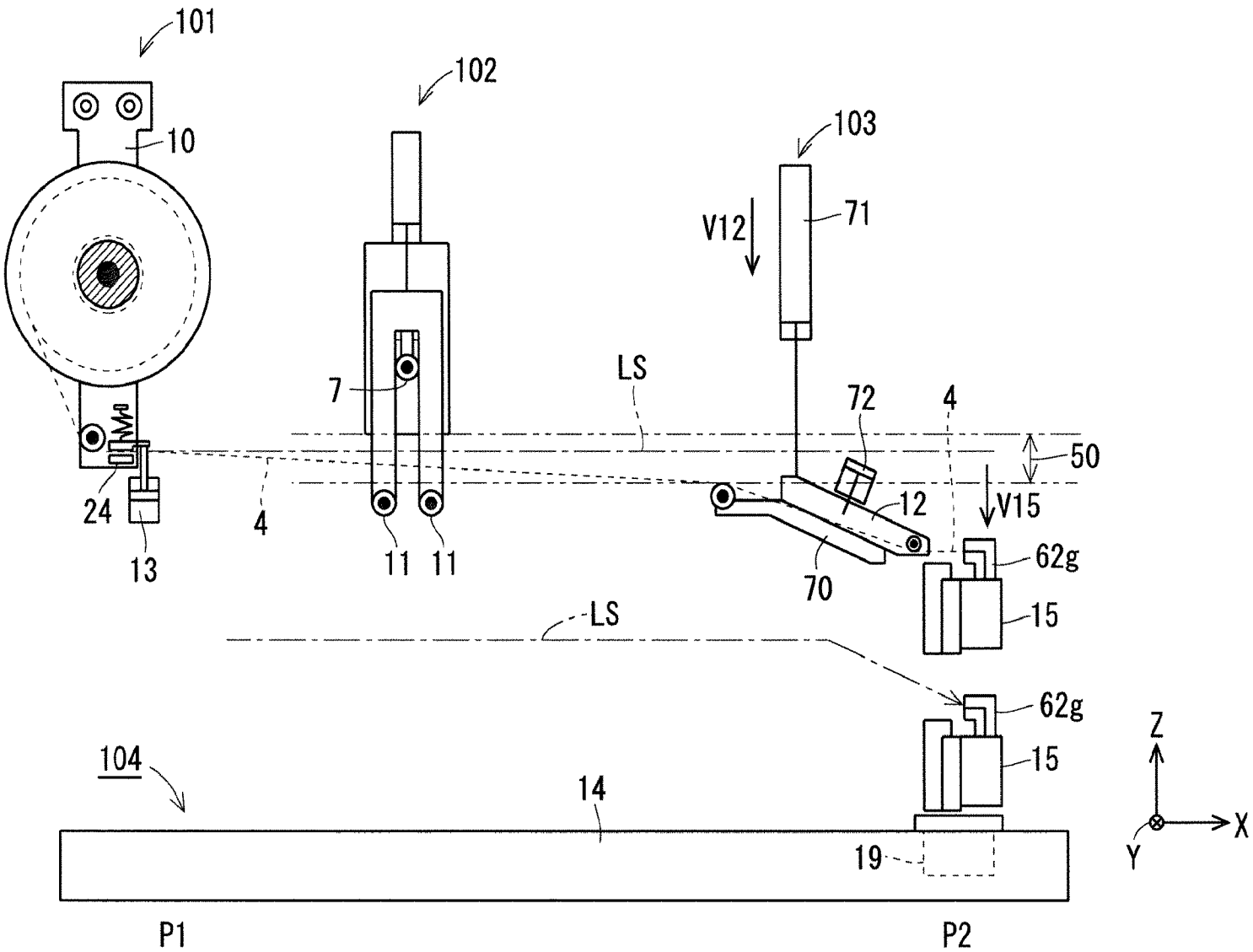
FIGS. 10A and 10B are explanatory views showing an operation content of the lead wire pulling out initial setting process.
Figures 11A, 11B:
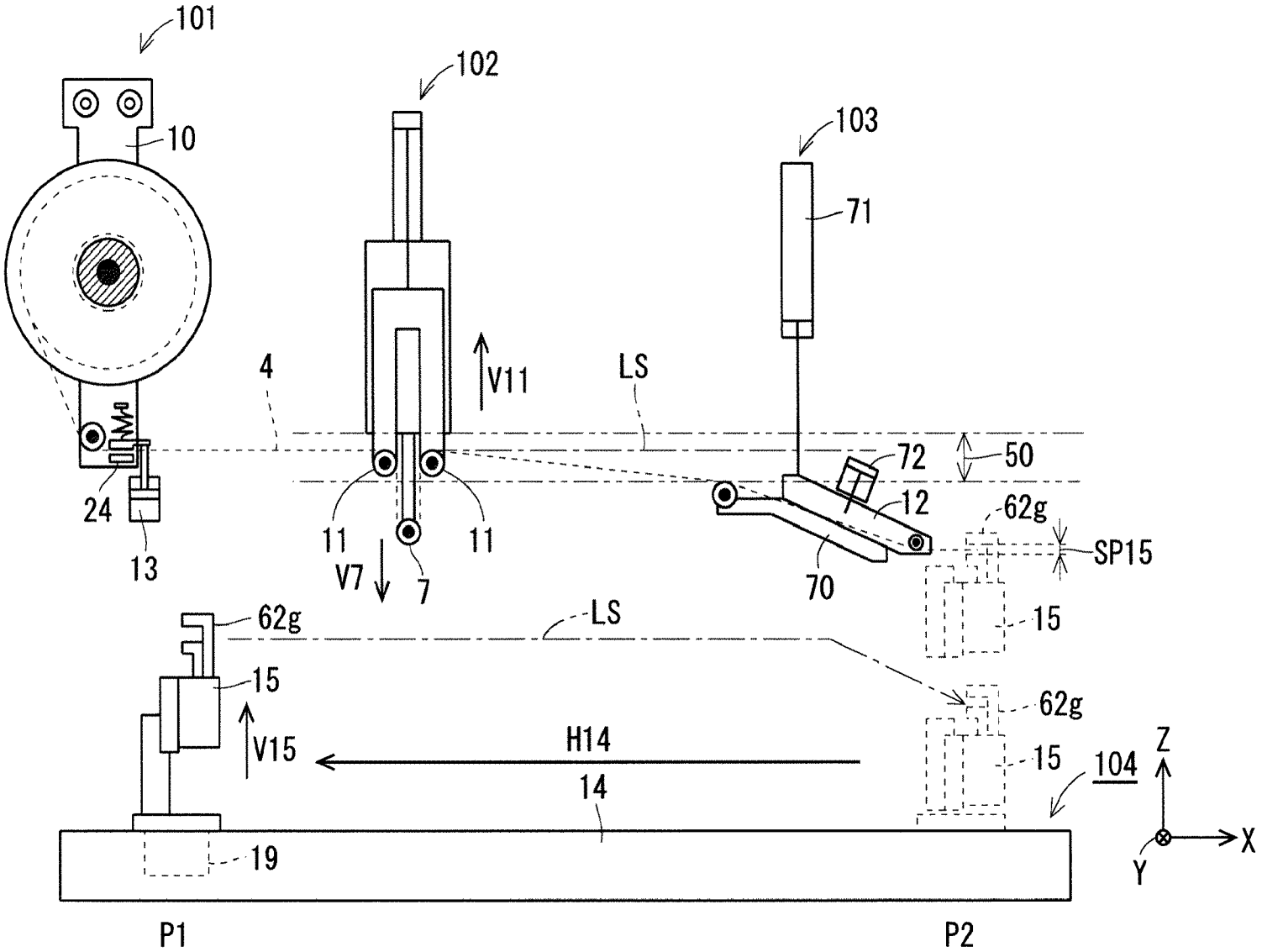
FIGS. 11A and 11B are explanatory views showing an operation content of the lead wire pulling out initial setting process.

FIGS. 10A, 10B, 11A and 11B show a state in which a process corresponding to step (d) of the lead wire pulling out initial setting process described above is executed. FIGS. 11A and 11B also show a state in which a process corresponding to step (e) of the lead wire pulling out initial setting process described above is executed.

Figure 20:
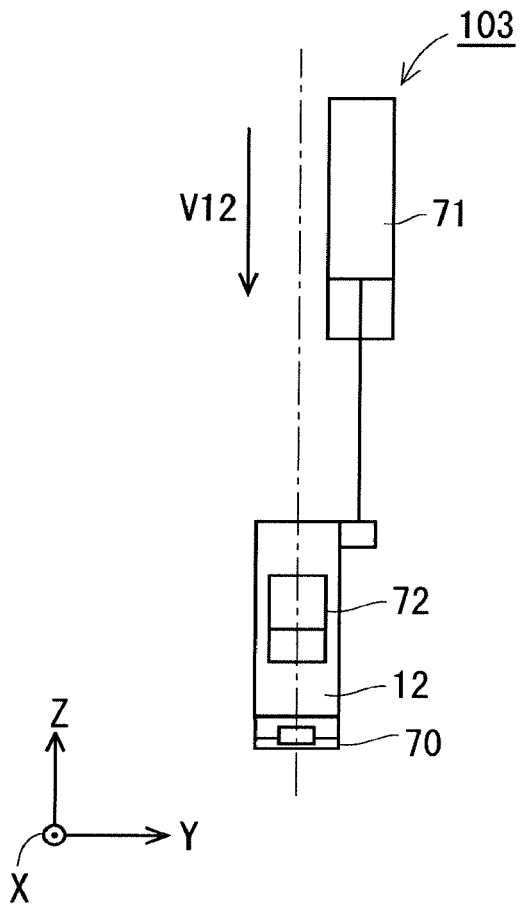
FIG. 20 is an explanatory view showing an operation content of the lead wire pulling out initial setting process.

As shown in FIGS. 10A and 20, the grasping part 62*g* of the lead wire grasping and moving mechanism 104 is lowered in the vertical movement direction V15 (−Z direction), and simultaneously, the lead wire guide mechanism 103 is set to the actual operation state (second actual operation state). That is, the opening and closing lead guide 12 is lowered from the preparation state (second preparation state) along the vertical movement direction V12 (−Z direction) by the lead guide lifting and lowering cylinder 71.

In the lead wire guide mechanism 103, in the actual operation state, the opening and closing lead guide 12 is positioned below the drawing reference line LS, and a minute space for gently holding the lead wire 4 between a lower surface of the opening and closing lead guide 12 and an upper surface of the fixed lead guide 70 is secured. That is, the lead wire 4 is held in the minute space described above so as to be capable of being pulled out from the tip end portion.

Therefore, at the time of the actual operation, by sandwiching the lead wire 4 from above and below by the opening and closing lead guide 12 and the fixed lead guide 70, and passing the lead wire 4 through the minute space described above, the lead wire guide mechanism 103 can execute a guide process for guiding the lead wire 4 in a traveling direction toward a lower side (−Z direction) with movement of the lead wire 4 in the horizontal direction (+X direction). By this guide process, the lead wire 4 can be guided to a surface of the substrate (not shown) that is to be a welding target.

Figure 17:
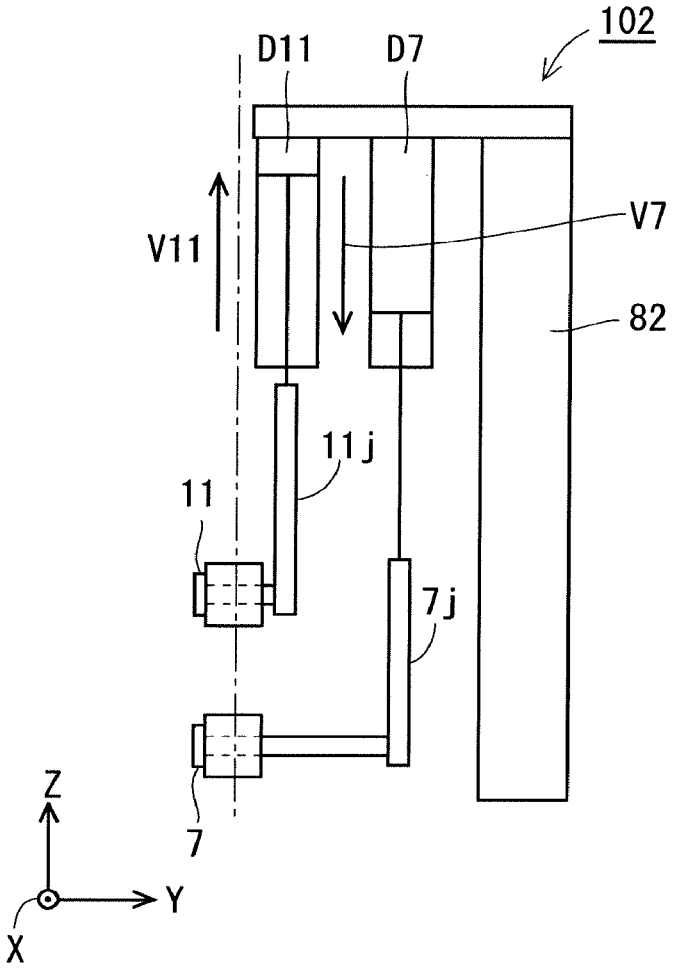
FIG. 17 is an explanatory view showing an operation content of the lead wire pulling out initial setting process.

Subsequently, as shown in FIGS. 11A and 17, the tension adjusting mechanism 102 is set to the actual operation state (first actual operation state). That is, the lifting and lowering guide roller 11 is lifted from the preparation state along the vertical movement direction V11 (+Z direction) by the lifting and lowering driving part D11, and the dancer roller 7 is lowered from the preparation state along the vertical movement direction V7 (−Z direction) by the lifting and lowering driving part D7. Note that the lifting and lowering driving part D11 and the lifting and lowering driving part D7 are mounted to the machine frame 82.

In the tension adjusting mechanism 102, in the actual operation state, the lifting and lowering guide roller 11 is positioned near the drawing reference line LS while the dancer roller 7 is positioned below the drawing reference line LS.

Therefore, at the time of the actual operation, by maintaining the contact relationship with the lead wire 4 on an upper outer peripheral surface of the two lifting and lowering guide rollers 11, and maintaining the contact relationship with the lead wire 4 on the lower outer peripheral surface of the dancer roller 7, the tension adjusting mechanism 102 can execute the tension adjustment process for adjusting a tension applied to the lead wire 4 to be constant.

In this way, the process corresponding to step (d) for setting the tension adjusting mechanism 102 to the actual operation state (first actual operation state) and setting the lead wire guide mechanism 103 to the actual operation state (second actual operation state) is executed.

Then, as indicated by a broken line in FIGS. 11A and 11B, the grasp release space SP15 is provided to the grasping part 62*g* in the lifting and lowering hand unit 15 of the lead wire grasping and moving mechanism 104, and the grasping operation for grasping the tip end portion of the lead wire 4 is ended. As a result, the lead wire 4 is released from the lead wire grasping and moving mechanism 104.

In this way, the process corresponding to step (e) for ending the grasping operation is executed by the grasping part 62*g*.

Figure 12A:
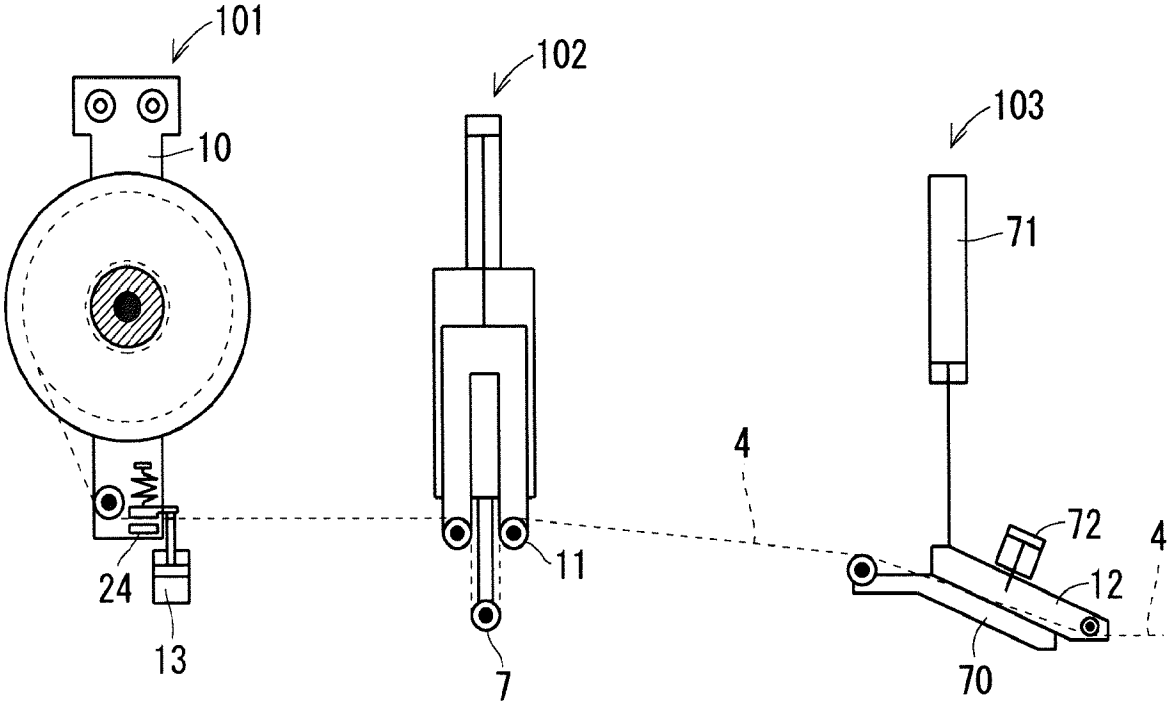
FIGS. 12A and 12B are explanatory views showing an operation content of the lead wire pulling out initial setting process.
Figure 12B:
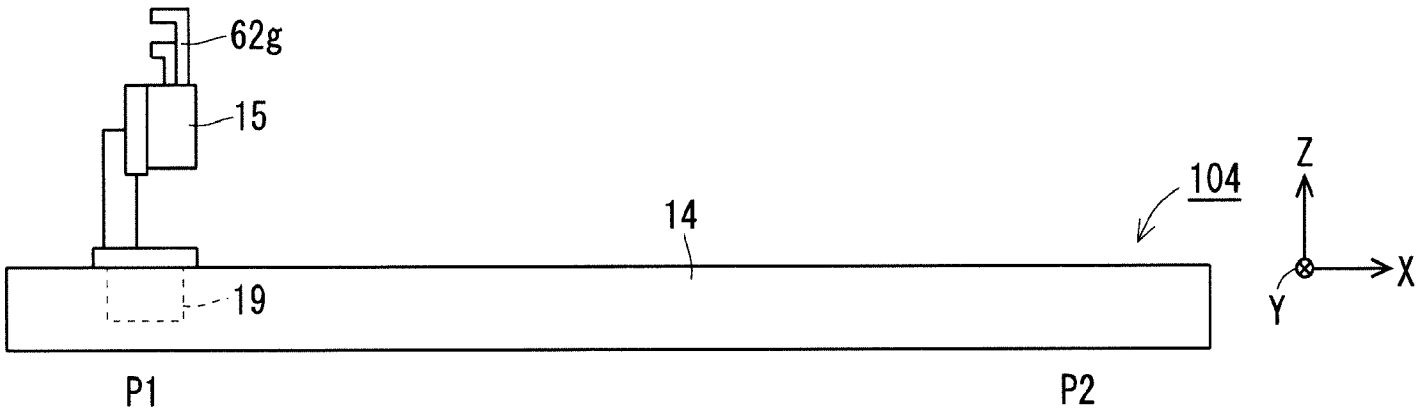

Thereafter, the chucking hand 62 is moved in the horizontal movement direction H62 (−Y direction) and returned to a state indicated by a solid line in FIG. 6, and then the lifting and lowering hand unit 15 is moved in the horizontal movement direction H14 (−X direction) and returned to the initial position P1 as indicated by the solid line in FIG. 11B and FIG. 12B. Further, at the initial position P1, the lifting and lowering hand unit 15 is lifted in the vertical movement direction V15 (+Z direction), and set to an initial state in which the arrangement of the grasping part 62*g* is in the vicinity of the drawing reference line LS.

When the lead wire pulling out initial setting process described above is ended, the lead wire 4 can be welded to the surface of the substrate that is the welding target, by applying ultrasonic vibration to the welding target region of the lead wire 4 by the ultrasonic welding equipment 1 shown in FIG. 22, for example, in a state in which the lead wire 4 is arranged on the surface of the substrate (not shown).

(Effect)

The lead wire pulling out mechanism 100 according to the present embodiment exhibits an effect of being capable of guiding a tip end portion of the lead wire 4 from the initial position P1 to the target position P2 while eliminating necessity of a manual operation by an operator, by automatically executing the lead wire pulling out initial setting process including steps (a) to (e) described above under control of the control unit 105.

Furthermore, by fixing the tip end portion of the lead wire 4 by the lock mechanism 24 in the lead wire storage mechanism 101 to cause the lead wire fixed state, the lead wire pulling out mechanism 100 can store the lead wire 4 in the lead cassette 10 (winding region 10*w*) without loosening.

In addition, by releasing the tip end portion of the lead wire 4 by the unlocking mechanism 13 in the lead wire storage mechanism 101 to cause the lead wire released state, the tip end portion of the lead wire 4 can be pulled from the winding region 10*w* to the outside.

Therefore, by causing the lead wire grasping and moving mechanism 104 to execute the grasping operation at the time of the lead wire fixed state described above, and then causing the lead wire grasping and moving mechanism 104 to execute the grasping part moving operation at the time of the lead wire released state described above, both the grasping operation and the grasping part moving operation by the lead wire grasping and moving mechanism 104 can be executed without any trouble, for the lead wire 4 stored in a wound state in the winding region 10*w* of the lead cassette 10.

Further, the lead wire storage mechanism 101 has the remaining amount detector 16. Therefore, by detecting occurrence of the lead wire remaining amount shortage state by the remaining amount detector 16, it is possible to automatically recognize necessity of replacing the lead cassette 10 with a new lead cassette 10.

For example, as shown in FIG. 5, it is conceivable to prepare a plurality of replacement lead cassettes 10 in advance. Then, by using, as a trigger, an output of the remaining amount detection signal S16 indicating the lead wire remaining amount shortage state by the remaining amount detector 16, the lead cassette 10 in use can be removed from the lead wire pulling out mechanism 100, and one lead cassette 10 among the plurality of prepared lead cassettes 10 can be incorporated into the lead wire pulling out mechanism 100 as a new lead cassette 10.

In addition, the tension adjusting mechanism 102 has the breakage detector 17. Therefore, by detecting a disconnection state of the lead wire 4 by the breakage detector 17, it is possible to automatically recognize necessity of performing again the lead wire pulling out initial setting process described above.

While the present invention has been described in detail, the foregoing description is in all aspects illustrative, and the present invention is not limited thereto. It is understood that innumerable modifications not illustrated can be envisaged without departing from the scope of the present invention.

The invention claimed is:

1. A lead wire pulling out mechanism comprising:

a lead wire storage mechanism that stores a lead wire to be capable of being taken out from a tip end portion;

a lead wire grasping and moving mechanism that has a grasping part and is capable of executing a grasping operation for automatically grasping the tip end portion of said lead wire at an initial position, with the grasping part, and a grasping part moving operation for moving said grasping part from said initial position to a target position through a lead wire movement space;

a tension adjusting mechanism that has at least one roller, and executes a tension adjustment process for adjusting a tension applied to said lead wire, by maintaining a contact relationship between said at least one roller and said lead wire;

a lead wire guide mechanism that executes a guide process for guiding a traveling direction of said lead wire by sandwiching said lead wire; and a control unit that controls said lead wire storage mechanism, said lead wire grasping and moving mechanism, said tension adjusting mechanism, and said lead wire guide mechanism, to control execution of a lead wire pulling out initial setting process, wherein said grasping part moving operation is a moving operation along only one direction, said initial position is placed between said lead wire storage mechanism and said tension adjusting mechanism and between said lead wire storage mechanism and said lead wire guide mechanism, a state in said tension adjusting mechanism changes between a first preparation state of forming a first partial space that is to be a part of said lead wire movement space and a first actual operation state in which said tension adjustment process is executable, a state in said lead wire guide mechanism changes between a second preparation state of forming a second partial space that is to be a part of said lead wire movement space and a second actual operation state in which said guide process is executable, said lead wire pulling out initial setting process executed under control of said control unit includes the steps of:

(a) causing said lead wire grasping and moving mechanism to execute said grasping operation at said initial position to grasp the tip end portion of said lead wire stored in said lead wire storage mechanism;

(b) setting said tension adjusting mechanism to said first preparation state, and setting said lead wire guide mechanism to said second preparation state; and (c) causing said lead wire grasping and moving mechanism that is executing said grasping operation to further execute said grasping part moving operation to move said grasping part from said initial position to said target position, wherein by execution of said step (c), the tip end portion of said lead wire grasped by said grasping part passes through said lead wire movement space including said first and second partial spaces, and then guided to said target position together with said grasping part, and said grasping part moving operation is ended after the execution of said step (c), and said lead wire pulling out initial setting process further includes the steps of:

(d) after execution of said step (c), setting said tension adjusting mechanism to said first actual operation state and setting said lead wire guide mechanism to said second actual operation state; and (e) after execution of said step (c), ending said grasping operation by said grasping part and releasing said lead wire from said lead wire grasping and moving mechanism.

2. The lead wire pulling out mechanism according to claim 1, wherein said lead wire storage mechanism includes a support shaft that is rotatable and tension variable, said lead wire being wound around said support shaft as a central axis and stored in such a manner that the tip end portion is exposed to outside, and further includes a lock mechanism capable of switching between fixing and releasing of the tip end portion of said lead wire exposed to the outside.

3. The lead wire pulling out mechanism according to claim 1, wherein said lead wire storage mechanism includes a remaining amount detector that detects presence or absence of a lead wire remaining amount shortage state in which a remaining amount of said lead wire is equal to or less than a reference amount.

4. The lead wire pulling out mechanism according to claim 1, wherein said tension adjusting mechanism includes a breakage detector that detects presence or absence of disconnection of said lead wire at a time of said first actual operation state.

* * * * *